US009863417B2

(12) United States Patent
Kumasaka et al.

(10) Patent No.: US 9,863,417 B2
(45) Date of Patent: Jan. 9, 2018

(54) VARIABLE DISPLACEMENT VANE PUMP

(71) Applicant: HITACHI AUTOMOTIVE SYSTEMS STEERING, LTD., Hiki-gun, Saitama (JP)

(72) Inventors: Norikazu Kumasaka, Atsugi (JP); Masaaki Iijima, Maebashi (JP); Yukio Uchida, Atsugi (JP); Satoshi Muramatsu, Atsugi (JP)

(73) Assignee: HITACHI AUTOMOTIVE SYSTEMS STEERING, LTD., Saitama (JP)

( * ) Notice: Subject to any disclaimer, the term of this patent is extended or adjusted under 35 U.S.C. 154(b) by 470 days.

(21) Appl. No.: 14/489,094

(22) Filed: Sep. 17, 2014

(65) Prior Publication Data

US 2015/0078944 A1 Mar. 19, 2015

(30) Foreign Application Priority Data

Sep. 19, 2013 (JP) ..... 2013-194392

(51) Int. Cl.

| | |
|---|---|
| ***F04C 14/22*** | (2006.01) |
| ***F04C 14/26*** | (2006.01) |
| ***F01C 21/08*** | (2006.01) |
| ***F04C 2/344*** | (2006.01) |
| ***F04C 15/06*** | (2006.01) |
| ***F01C 21/10*** | (2006.01) |

(52) U.S. Cl.

CPC ..... *F04C 14/226* (2013.01); *F01C 21/0863* (2013.01); *F01C 21/108* (2013.01); *F04C 2/344* (2013.01); *F04C 2/3442* (2013.01); *F04C 2/3446* (2013.01); *F04C 14/223* (2013.01); *F04C 14/26* (2013.01); *F04C 15/06* (2013.01); *F04C 2240/811* (2013.01)

(58) Field of Classification Search

CPC ..... F04C 14/226; F04C 14/26; F04C 14/223; F04C 2/3446; F04C 2/3442; F04C 2/344; F04C 15/06; F01C 21/0863; F01C 21/108

See application file for complete search history.

(56) References Cited

FOREIGN PATENT DOCUMENTS

JP 2012-087777 A 5/2012

*Primary Examiner* — Mark Laurenzi
*Assistant Examiner* — Wesley Harris
(74) *Attorney, Agent, or Firm* — Foley & Lardner LLP

(57) ABSTRACT

A variable displacement vane pump is provided. This pump includes a pump housing including, a driving shaft, a rotor, a plurality of vanes, a cam support surface, a cam ring, an intake port formed at the pump housing, a discharge port formed at the pump housing, and a cam ring control mechanism disposed at the pump housing and configured to control an eccentric amount of the cam ring with respect to the rotor. The cam support surface is formed in such a manner that a shortest distance between the cam support surface and a reference line decreases from a second confining region side toward a first confining region side, and the cam ring is formed in such a manner that a cam profile radius change rate decreases first and then increases again on the second confining region side when eccentric amount of the cam ring is maximized.

17 Claims, 12 Drawing Sheets

VARIABLE DISPLACEMENT VANE PUMP

TECHNICAL FIELD

The present invention relates to a variable displacement vane pump.

BACKGROUND ART

Conventionally, there have been known variable displacement vane pumps including vanes contained in slits of a rotor in such a manner that the vanes can be projected therefrom and inserted therein, and configured to change volumes of pump chambers defined among an inner circumferential surface of a cam ring, an outer circumferential surface of the rotor, and the vanes. Japanese Patent Application Public Disclosure No. 2012-87777 discusses one example relating to the above-described technique.

SUMMARY

The above-described conventional apparatuses have been subject to a demand of further reducing a so-called surge pressure, which is a sudden increase in pressures in the pump chambers during a low-revolution operation.

One object of the present invention is to provide a variable displacement vane pump capable of preventing or reducing the surge pressure during the low-revolution operation.

According to an aspect of the present invention, a variable displacement vane pump includes a cam support surface formed on an inner circumferential side of a pump element containing portion, and a cam ring. Assume that respective terms mean the following definitions. A first confining region is a space between a terminal end of a discharge port and a start end of an intake port. A second confining region is a space between a terminal end of the intake port and a start end of the discharge port. A reference point is a middle point between the start end of the intake port and the terminal end of the discharge port in a circumferential direction. A reference line is a line perpendicularly intersecting with a rotational axis of a driving shaft of a rotor and passing through the reference point. In this case, the cam support surface is formed in such a manner that a shortest distance between the cam support surface and the reference line decreases from the second confining region side toward the first confining region side. The cam ring is formed in such a manner that a cam profile radius change rate decreases first and then increases again on the second confining region side when an eccentric amount of the cam ring is maximized.

Therefore, the variable displacement vane pump according to the present invention can prevent or reduce the surge pressure during the low-revolution operation.

DESCRIPTION OF EMBODIMENTS

[First Embodiment]

[Configuration of Variable Displacement Vane Pump]

Figure 1:
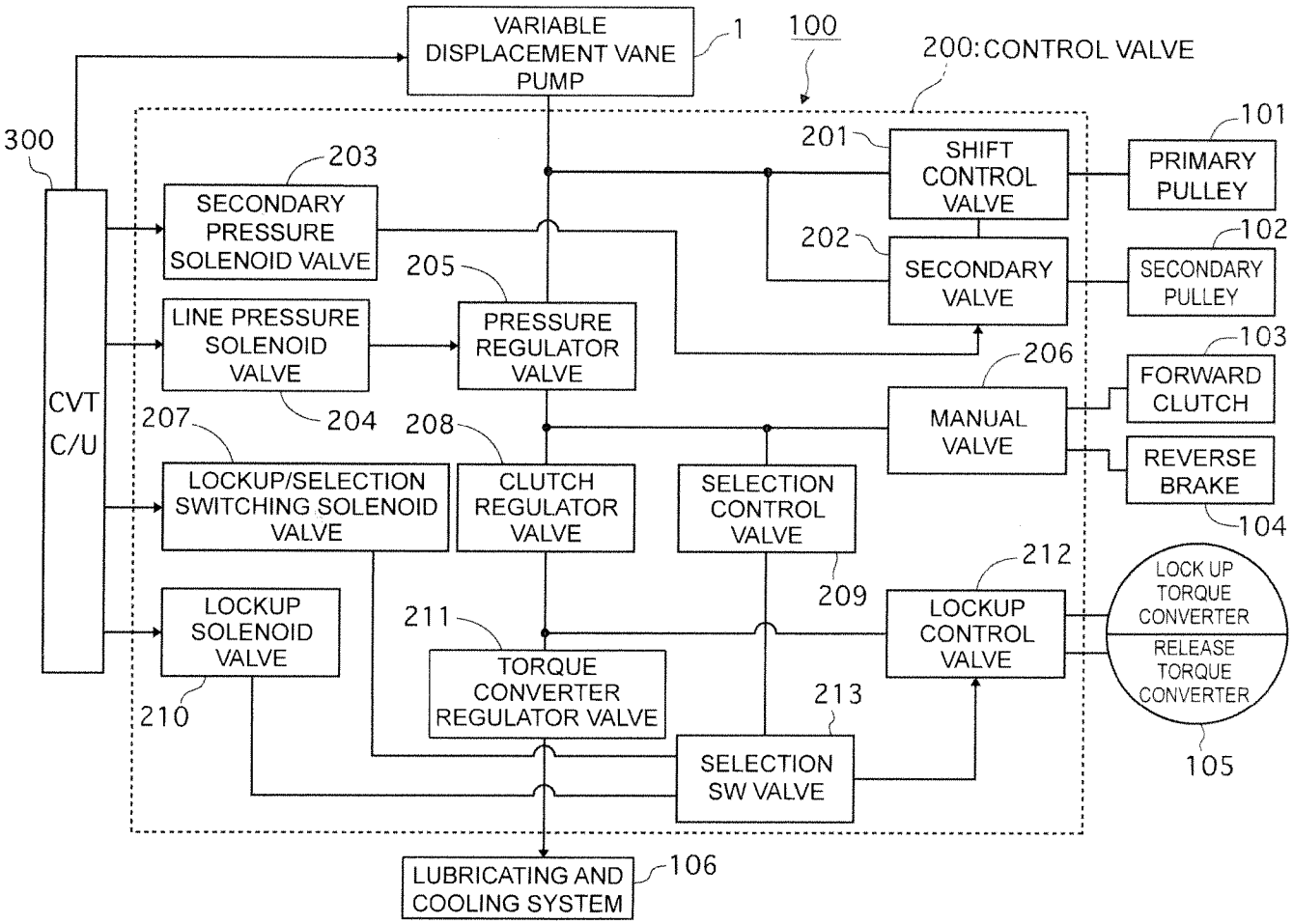
FIG. 1 is a block diagram illustrating a CVT for which a variable displacement vane pump according to a first embodiment is employed.

FIG. 1 is a block diagram illustrating an example of a belt stepless transmission (CVT) 100 for which a variable displacement vane pump (hereinafter referred to as a vane pump) 1 according to a first embodiment is employed. Now, an overview of the variable displacement vane pump (hereinafter referred to as the vane pump) 1 according to the first embodiment will be described. The vane pump 1 is used as a hydraulic supply source of the CVT 100.

The vane pump 1 is driven by a crank shaft (not illustrated) of an internal combustion engine (engine) to introduce and discharge hydraulic fluid. Hydraulic oil, more specifically, ATF (automatic transmission fluid) is used as the hydraulic fluid. The hydraulic oil (ATF) has a large elastic coefficient, and has such a property that its pressure largely changes in response to a slight volume change.

Various kinds of valves 201 to 213, which are controlled by a CVT control unit 300, are disposed in a control valve 200. The hydraulic oil discharged from the vane pump 1 is supplied to respective portions (a primary pulley 101, a secondary pulley 102, a forward clutch 103, a reverse brake 104, a torque converter 105, a lubricating and cooling system 106, and the like) of the CVT 100 via the control valve 200.

The vane pump 1 is a variable displacement type pump capable of adjusting a fluid amount discharged from one rotation (hereinafter referred to as a pump volume), and includes a pump portion 2 that introduces and discharges the hydraulic oil, and a control portion 3 that controls the pump volume as an integrated single unit.

[Configuration of Pump Portion]

As main components, the pump portion 2 includes: a driving shaft 5 configured to be driven by the crank shaft; a rotor 6 configured to be rotationally driven by the driving shaft 5; vanes 7 respectively contained in a plurality of slits 61 formed on an outer circumference of the rotor 6 so as to be able to be projected therefrom and inserted therein; a cam ring 8 disposed so as to surround the rotor 6; an adapter ring 9 disposed so as to surround the cam ring 8; a plate 41 disposed on an axial side surface of the cam ring 8 and the rotor 6 to define a plurality of pump chambers r together with the cam ring 8, the rotor 6, and the vanes 7; a rear body 40 (a pump housing) 40 including a containing hole 400 to contain the plate 41 at a bottom portion 402 of the containing hole 400 and contain the cam ring 8, the rotor 6, and the vanes 7 in the containing hole 400; and a front body (the pump housing) 42 closing the containing hole 400 of the rear body 40 and defining the plurality of pump chambers r together with the cam ring 8, the rotor 6, and the vanes 7.

Figure 2:
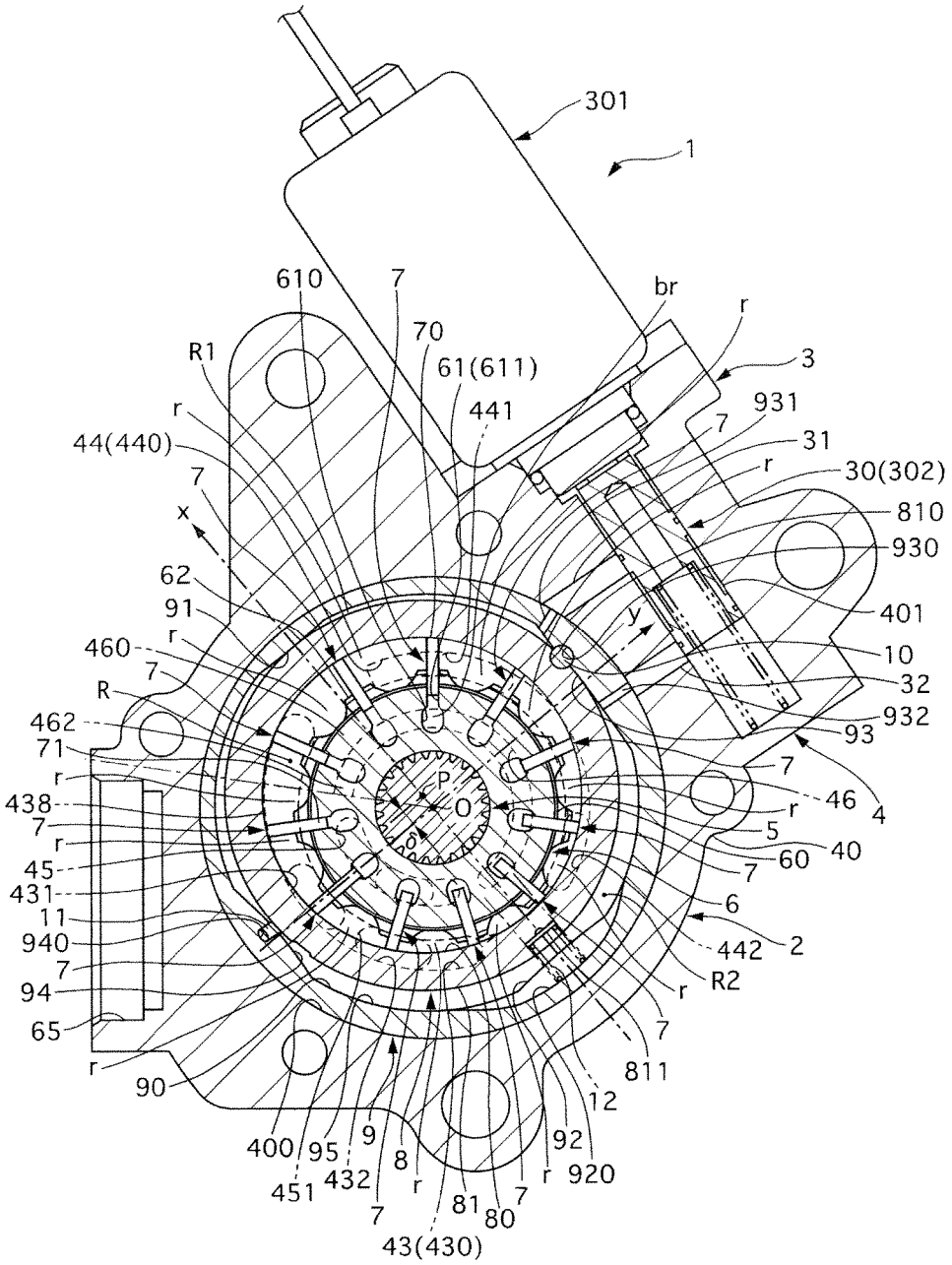
FIG. 2 is a cross-sectional view illustrating an interior of the variable displacement vane pump according to the first embodiment as viewed from a direction along a rotational axis.

FIG. 2 is a partial cross-sectional view illustrating an interior of the vane pump 1 as viewed from a direction along a rotational axis. For convenience of the description, a three-dimensional orthogonal coordinate system is provided with an x axis and a y axis set to a radial direction of the vane pump 1 and a z axis set to the direction along the rotational axis of the vane pump 1. The z axis is set to the rotational axis O of the vane pump 1. The x axis is set to a direction in which a central axis P of the cam ring 8 swings with respect to the rotational axis O. The y axis is set to a direction perpendicular to the x axis and the z axis. Assume that the front side of the sheet of FIG. 2 is a positive direction of the z axis, a direction in which the axis P moves away from the axis O (a direction from a first confining region toward a second confining region; refer to FIG. 3) is a positive direction of the x axis, and a direction from an intake region toward a discharge region is a positive direction of the y axis.

[Configuration of Adapter Ring]

The substantially cylindrical containing hole 400 extending in the z axis direction is formed in the rear body 40. The annular adapter ring 9 is mounted in this containing hole 400.

An inner circumferential surface of the adapter ring 9 defines a substantially cylindrical containing hole 90 extending in the z axis direction. A first flat surface portion 91 substantially in parallel with a yz plane is formed at the containing hole 90 on the positive direction side of the x axis. A second flat surface portion 92 substantially in parallel with the yz plane is formed at the containing hole 90 in the negative direction side of the x axis. A stepped portion 920 is formed at a substantially central position of the second flat surface portion 92 in the z axis direction so as to extend in the negative direction of the x axis.

A cam support surface 93 is formed at the containing hole 90 on the positive direction side of the y axis. The cam support surface 93 is disposed so that an area located on the the positive direction side of the x axis is slightly larger than an area located on the negative direction side of the x axis with respect to the rotational axis O. A groove (a recessed portion 930) semicircular as viewed from the z axis direction is formed on the cam support surface 93. Communication passages 931 and 932 radially extending through the adapter ring 9 are formed at the both sides of the recessed portion 930. The first communication passage 931 is opened on the cam support surface 93 on the positive direction side of the x axis with respect to the recessed portion 930, and the second communication passage 932 is opened adjacent to a portion of the cam support surface 93 in the negative direction of the x axis. A fourth flat surface portion 94 substantially in parallel with the xz plane is formed at the containing hole 90 on the negative direction side of the y axis. A groove (a recessed portion 940) rectangular as viewed from the z axis direction is formed on the fourth flat surface portion 94.

[Configuration of Cam Ring]

The annular cam ring 8 is swingably mounted in the containing hole 90 of the adapter ring 9. In other words, the adapter ring 9 is disposed so as to surround the cam ring 8. A cam ring inner circumferential surface 80 and a cam ring outer circumferential surface 81 of the cam ring 8 are substantially circular as viewed from the z axis direction, and the cam ring 8 has a substantially constant radial width. A groove (a recessed portion 810) semicircular as viewed from the z axis direction is formed on a portion of the cam ring outer circumferential surface 81 of the cam ring 8 in the positive direction of the y axis.

A substantially cylindrical recessed portion 811 having an axis in the x axis direction is formed at a portion of the cam ring outer circumferential surface 81 of the cam ring 8 in the negative direction of the x axis so as to have a predetermined depth. A seal pin 10 extending in the z axis direction is disposed in abutment with the respective recessed portions 930 and 810 so as to be sandwiched by the recessed portions 930 and 810 between the recessed portion 930 formed on the inner circumference of the adapter ring 9 and the recessed portion 810 formed on the outer circumference of the cam ring 8.

A seal member 11 is mounted in the above-described recessed portion 940 formed on the inner circumference of the adapter ring 9. The seal member 11 is in abutment with the cam ring outer circumferential surface 81 on the negative direction side of the y axis.

One end of a spring 12 as an elastic member is mounted in the stepped portion 920 formed on the inner circumference of the adapter ring 9. The spring 12 is a coil spring. The other end of the spring 12 is fittedly inserted in the recessed portion 811 formed on the outer circumference of the cam ring 8. The spring 12 is mounted in a compressed state, and constantly biases the cam ring 8 against the adapter ring 9 in the positive direction of the x axis.

An dimension of the containing hole 90 of the adapter ring 9 in the x axis direction, i.e., a distance between the first flat surface portion 91 and the second flat surface portion 92 is set so as to be longer than a diameter of the cam ring outer circumferential surface 81. The cam ring 8 is supported at the cam support surface 93 to the adapter ring 9, and is mounted swingably about the cam support surface 93 in the xy plane. The seal pin 10 prevents the cam ring 8 from having a positional deviation (a relative rotation) from the adapter ring 9.

A swinging movement of the cam ring 8 is limited by the cam ring outer circumferential surface 81 abutting against the first flat surface 91 of the adapter ring 9 in the positive direction of the x axis, and is limited by the cam ring outer circumferential surface 81 abutting against the second flat surface portion 92 of the adapter ring 9 in the negative direction of the x axis. An eccentric amount of the central axis P of the cam ring 8 from the rotational axis O is represented by the symbol "δ". The eccentric amount δ is minimized at a position where the cam ring outer circumferential surface 81 is in abutment with the second flat surface portion 92 (a minimum eccentric position). The eccentric amount δ is maximized at a position illustrated in FIG. 2 where the cam ring outer circumferential surface 81 is in abutment with the first flat surface portion 91 (a maximum eccentric position). When the cam ring 8 swings, the cam ring 8 moves as if it is rolling on the cam support surface 93.

[Configurations of Control Chambers]

The space between the adapter ring inner circumferential surface 95 and the cam ring outer circumferential surface 81 is sealingly closed by the plate 41 at a portion thereof in the negative direction of the z axis and the front body 42 at a portion thereof in the positive direction in the z axis, and is liquid-tightly divided into two control chambers R1 and R2 by the seal pin 10 and the seal member 11.

The first control chamber R1 is defined on the positive direction side of the x axis, and the second control chamber R2 is defined on the negative direction side of the x axis. The first communication passage 931 is opened to the first control chamber R1, and the second communication passage 932 is opened to the second control chamber R2. The predetermined space is secured between the outer circumference of the cam ring 8 and the inner circumference of the adapter ring 9 at the above-described limited positions, whereby the first and second control chambers R1 and R2 have predetermined or greater volumes that are never reduced to zero.

[Configuration of Rotor]

The driving shaft 5 is rotatably supported at the body 4 (the rear body 40, the plate 41, and the front body 42) The driving shaft 5 is coupled to the crank shaft of the internal combustion engine via a chain, and rotates synchronously with the crank shaft. The rotor 6 is coaxially fixed to an outer circumference of the driving shaft 5 (through spline coupling). The rotor 6 is substantially cylindrical, and is mounted on an inner circumferential side of the cam ring 8. In other words, the cam ring 8 is disposed so as to surround the rotor 6. An annular chamber R is defined between a rotor outer circumferential surface 60 of the rotor 6, a cam ring inner circumferential surface 80 of the cam ring 8, the plate 41, and the front body 42. The rotor 6 rotates about the rotational axis O in a clockwise direction in FIG. 2 together with the driving shaft 5.

A plurality of grooves (the slits 61) is radially formed at the rotor 6. Each of the slits 61 is formed so as to linearly extend from the rotor outer circumferential surface 60 toward the rotational axis O to reach a predetermined depth in a radial direction of the rotor 6 as viewed from the z axis direction, and is formed over a whole range of the rotor 6 in the z axis direction. The slits 61 are formed at eleven positions that circumferentially equally divide the rotor 6.

The vanes 7 are substantially rectangular plate members (vanes), and a plurality of (eleven) vanes 7 is provided. Each vane 7 is contained in each slit 61 so as to be able to be projected therefrom and inserted therein. A tip portion (a vane distal end portion 70) of the vane 7 located on a rotor outer diameter side (a portion located away from the rotational axis O) is formed into a gradually curved shape corresponding to the cam ring inner circumferential surface 80. The number of slits 61 and the number of vanes 7 are not limited to eleven.

An end (a slit proximal end portion 610) of each slit 61 on a rotor inner diameter side (a portion close to the rotational axis O) is formed into a substantially cylindrical shape, and has a substantially circular shape having a larger diameter than a width of a slit main body portion 611 in a circumferential direction of the rotor as viewed from the z axis direction. The slit proximal end portion 601 does not have to be formed into a cylindrical shape especially. For example, the slit proximal end portion 601 may have a groove shape similar to the slit main body portion 611. A backpressure chamber br (a pressure receiving portion) of the vane 7 is defined between the slit proximal end portion 610 and an end (a vane proximal end portion 71) of the vane 7 contained in this slit 61 on the rotor inner diameter side.

A protrusion 62 substantially trapezoidal as viewed from the z axis direction is formed on the rotor outer circumferential surface 60 at a position corresponding to each vane 7. The protrusion 62 is formed so as to protrude from the rotor outer circumferential surface 60 to a predetermined height over the whole range of the rotor 6 in the z axis direction. An opening of each slit 61 is formed at a substantially central position of the protrusion 62. The slit 61 is formed so as to have a substantially equal length in the rotor radial direction (a length including the protrusion 62 and the slit proximal end portion 610) to a length of the vane 7 in the rotor radial direction.

The provision of the protrusion 62 can ensure that the slit 61 has a predetermined or longer length in the rotor radial direction, thereby succeeding in securely holding the vane 7 in the slit 61, for example, even when the vane 7 is maximally projected from the slit 61 in the second confining region.

The annular chamber R is divided into the plurality of (eleven) pump chambers (volume chambers) r by the plurality of vanes 7. Hereinafter, a distance between adjacent vanes 7 (between side surfaces of the two vanes 7) in a rotational direction of the rotor 6 (in the clockwise direction in FIG. 2; hereinafter, referred to as simply the rotational direction) will be referred to as one pitch. A width of the single pump chamber r in the rotational direction is one pitch, and is invariable.

When the central axis P of the cam ring 8 is eccentrically located with respect to the rotational axis O (in the positive direction of the x axis), a distance between the rotor outer circumferential surface 60 and the cam ring inner circumferential surface 80 in the rotor radial direction (a radial dimension of the pump chamber r) increases as the position is located farther away from the negative direction side of the x axis toward the positive direction side of the x axis. The vanes 7 are projected from the slits 61 according to this change in the distance, whereby the respective pump chambers r are defined with the pump chambers r located on the positive direction side of the x axis having larger volumes than the pump chambers r located on the negative direction side of the x axis. Due to this difference between the volumes of the pump chambers r, the pump chambers r have increasing volumes as they move in the positive direction of the x axis, which is the rotational direction of the rotor 6 (the clockwise direction in FIG. 2), in a half divided by the x axis that is located on the negative direction side of the y axis while the pump chambers r have decreasing volumes as they move in the negative direction of the x axis, which is the rotational direction of the rotor 6 (in the clockwise direction in FIG. 2), in the other half divided by the x axis that is located on the positive direction side of the y axis.

[Configuration of Plate]

Figure 3:
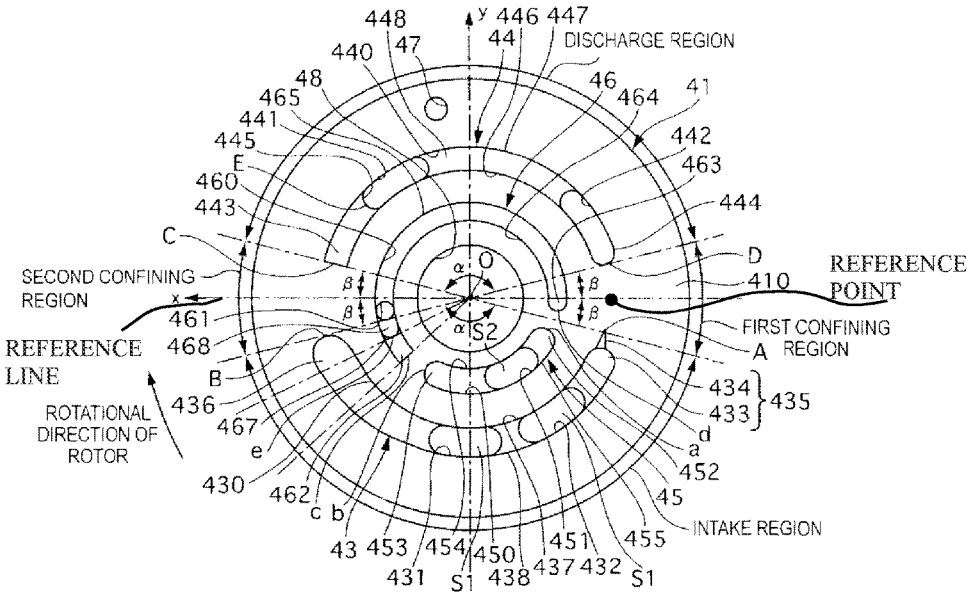
FIG. 3 is a plan view illustrating a plate according to the first embodiment as viewed from a positive direction of a z axis.

FIG. 3 is a plan view illustrating the plate 41 as viewed from the positive direction of the z axis. The plate 41 includes an intake port (an inlet port) 43, a discharge port (an outlet port) 44, an intake-side backpressure port 45, a discharge-side backpressure port 46, a pin mounting hole 47, and a through-hole 48. The seal pin 10 is inserted in the pin mounting hole 47 and is fixedly mounted therein. The driving shaft 5 is inserted in the through-hole 48, and is rotatably mounted therein.

[Configuration of Intake Port]

The intake port 43 is a portion serving as an inlet when the hydraulic oil is externally introduced into the intake-side pump chambers r, and is formed in a section located on the negative direction side of the y axis where the pump chambers r have increasing volumes as the rotor 6 rotates. The intake port 43 includes an intake-side circular arc groove 430, and intake holes 431 and 432. The intake-side circular arc groove 430 is formed on a surface 401 of the plate 41 that is located on the positive direction side of the z axis. The intake-side circular arc groove 430 is a groove through which a pump intake-side hydraulic pressure is introduced, and is formed into a substantially circular arch shape extending about the rotational axis O along an arrangement of the intake-side pump chambers r.

An intake region of the vane pump 1 is provided in an angular range corresponding to the intake-side circular arc groove 430, i.e., a range of an angle α corresponding to substantially 4.5 pitches defined by a start end A (a point where one of the vanes 7 is placed into alignment with the intake port 43 for the first time after moving away from a discharge region as the rotor 6 rotates) of the intake-side circular arc groove 430 on the negative direction side of the x axis with respect to the rotational axis O and a terminal end B (a point where one of the vanes 7 is in alignment with the intake port 43 for the last time in the intake region) of the intake-side circular arc groove 430 on the positive direction side of the x axis with respect to the rotational axis O. The start end A and the terminal end B of the intake-side circular arc groove 430 are formed at positions away from the x axis by an angle β corresponding to an approximately 0.5 pitch in the negative direction of the y axis.

A terminal end portion 436 of the intake-side circular arc groove 430 is formed into a substantially semicircular arc shape protruding in the rotational direction. A main body start end portion 433 formed into a substantially semicircular arc shape protruding in a rotational negative direction, and a notch 434 continuous from the main body start end portion 433 are formed at a start end portion 435 of the intake-side circular arc groove 430. The notch 434 is formed so as to extend by a length corresponding to an approximately 0.5 pitch from the main body start end portion 433 in a pump rotational direction and the rotational negative direction. A tip of the notch 434 coincides with the start end A. The intake-side circular arc groove 430 is formed so as to have a substantially constant width in the rotor radial direction over a whole range in the rotational direction (refer to FIG. 2).

An edge 437 of the intake-side circular arc groove 430 on the rotor inner diameter side is located slightly on the rotor outer diameter side with respect to the rotor outer circumferential surface 60 (except for the protrusions 62). An edge 438 of the intake-side circular arc groove 430 on the rotor outer diameter side is located slightly on the rotor outer diameter side with respect to the cam ring inner circumferential surface 80 of the cam ring 8 located at the minimum eccentric position. The edge 438 on the terminal end side is located slightly on the rotor outer diameter side with respect to the cam ring inner circumferential surface 80 of the cam ring 8 located at the maximum eccentric position. The respective intake-side pump chambers r are in alignment with the intake-side circular arc groove 430 as viewed from the z axis direction while being in communication with the intake-side circular arc groove 430, regardless of the eccentric position of the cam ring 8.

The intake holes 431 and 432 are opened at a substantially central position of the intake-side circular arc groove 430 in the rotational direction. The intake hole 431 is substantially oval as viewed from the z axis direction and has a substantially equal width in the rotor radial direction to the intake-side circular arc groove 430. A length of the intake hole 431 in the rotational direction is an approximately one pitch. The intake holes 431 and 432 are formed so as to extend through the plate 41 in the z axis direction at positions in alignment with the y axis.

The intake-side circular arc groove 430 has a depth (in the z axis direction) slightly shallower than 20% of a thickness of the plate 41 (in the z axis direction) at the main body start end portion 433, a portion between the intake holes 431 and 432, and the terminal end portion 436.

A slope is formed from the main boy start end portion 433 to the intake hole 432 so as to be gradually deepened in the rotational direction to have an equal depth to the thickness of the plate 41 at the intake hole 432. A slope is formed from the intake hole 431 to the terminal end portion 436 so as to be gradually less deepened in the rotational direction to have an equal depth to the main body start end portion 433 at the terminal end portion 436.

The notch 434 is formed into a substantially sharp triangular shape having a gradually increasing width in the rotor radial direction along the rotational direction, as viewed from the z axis direction. The notch 434 is formed in such a manner that a maximum value of the width of the notch 434 in the rotor radial direction is smaller than the width of the intake-side circular arc groove 430. A depth of the notch 434 (in the z axis direction) gradually increases from zero to several percent of the thickness of the plate 41 in the rotational direction. In other words, a cross-sectional area of a flow passage defined by the notch 434 is smaller than that of the main body portion of the intake-side circular arc groove 430, and the notch 434 forms an orifice portion having a gradually increasing cross-sectional area of a flow passage in the rotational direction.

[Configuration of Discharge Port]

The discharge port 44 is a portion serving an outlet when the hydraulic oil is discharged from the discharge-side pump chambers r outwardly, and is formed in a section located on the positive direction side of the y axis where the pump chambers r have decreasing volumes as the rotor 6 rotates. The discharge port 44 includes a discharge-side circular arc groove 440 and discharge holes 441 and 442. The discharge-side circular arc groove 440 is formed on the surface 410 of the first plate 41. The discharge-side circular arc groove 440 is a groove through which a pump discharge-side hydraulic pressure is introduced, and is formed into a substantially circular arch shape extending about the rotational axis O along an arrangement of the discharge-side pump chambers r.

The discharge region of the vane pump 1 is provided in an angular range corresponding to the discharge-side circular arc groove 440, i.e., a range of the angle α defined by a start end C (a point where one of the vanes 7 is placed into alignment with the discharge port 44 for the first time after moving away from the intake region) of the discharge-side circular arc groove 440 on the positive direction side of the x axis with respect to the rotational axis O and a terminal end D (a point where one of the vanes 7 is in alignment with the discharge port 44 for the last time in the discharge region) of the discharge-side circular arc groove 440 on the negative direction side of the x axis with respect to the rotational axis O. The start end C and the terminal end D of the discharge-side circular arc groove 440 are formed at positions away from the x axis by the angle β corresponding to an approximately 0.5 pitch in the positive direction of the y axis.

The discharge-side circular arc groove 440 is formed in such a manner that a width thereof in the rotor radial direction is substantially constant over a whole range in the rotational direction, and is slightly narrower than the width of the intake-side circular arc groove 430 in the rotor radial direction. An edge 446 of the discharge-side circular arc groove 440 on the rotor inner diameter side is located slightly on the rotor outer diameter side with respect to the rotor outer circumferential surface 60 (except for the protrusions 62). An edge 447 of the discharge-side circular arc groove 440 on the rotor outer diameter side is substantially in alignment with the cam ring inner circumferential surface 80 of the cam ring 8 located at the minimum eccentric position. The respective discharge-side pump chambers r are in alignment with the discharge-side circular arc groove 440 as viewed from the z axis direction while being in communication with the discharge-side circular arc groove 440, regardless of the eccentric position of the cam ring 8.

The discharge hole 442 is opened at a terminal end portion 444 of the discharge-side circular arc groove 440 in the rotational direction. The discharge hole 442 is substantially oval as viewed from the z axis direction. The discharge hole 442 has a substantially equal width in the rotor radial direction to the discharge-side circular arc groove 440, and has a slightly longer length in the rotational direction than approximately one pitch. The discharge hole 442 is formed so as to extend through the plate 41 in the z axis direction. An edge of the discharge hole 442 in the rotational direction is formed into a substantially semicircular arc shape protruding in the rotational direction, and coincides with an edge of the terminal end portion 444 in the rotational direction.

A start end portion 443 of the discharge-side circular arc groove 440 is formed so as to extend from the start end C to an edge 445 of the discharge hole 441 in the rotational negative direction. The edge 445 is formed into a substantially semicircular arc shape protruding in the rotational negative direction as viewed from the z axis direction. A tip E of the edge 445 is located at a position away from the start end C by approximately one pitch in the rotational direction. A tip of the start end portion 443 opposite from the terminal end B of the intake-side circular arc groove 430 in the rotational direction is formed into a substantially rectangular shape as viewed from the z axis direction, and has an edge extending in the rotor radial direction.

A main body portion 448 formed between the discharge holes 441 and 442 of the discharge-side circular arc groove 440 has a depth (in the z axis direction) corresponding to substantially 25% of the thickness of the plate 41 (in the z axis direction). The start end portion 443 has a shallower groove depth than the main body portion 448, and a slope is formed from the start end C to the edge 445. The groove depth is zero at the start end C, and is gradually deepened toward the edge 445 to have a depth slightly shallower than 10% of the thickness of the first plate 41 at the edge 445.

The start end portion 443 is formed into a shape having a smaller cross-sectional area of a flow passage than the main body portion 448, and a gradually increasing depth (in the z axis direction) along the rotational direction, and defines an orifice portion having a gradually increasing cross-sectional area of a flow passage along the rotational direction. No groove is formed on the surface 410 between the terminal end B of the intake-side circular arc groove 430 and the start end C of the discharge-side circular arc groove 440, and the second confining region of the vane pump 1 is formed in an angular range corresponding to this section, i.e., a range corresponding to an angle of 2β defined by the terminal end B and the start end C with the rotational axis O. The angular range of the second confining region corresponds to approximately one pitch.

Similarly, no groove is formed on the surface 410 between the terminal end D of the discharge-side circular arc groove 440 and the start end A of the intake-side circular arc groove 430, and the first confining region is formed in an angular range corresponding to this section, i.e., a range corresponding to the angle 2β defined by the terminal end D and the start end A with the rotational axis O. The angular range of the first confining region corresponds to approximately one pitch.

[Confining Regions]

The first confining region and the second confining region are portions that confine the hydraulic oil in the pump chambers r located in these regions, and cut off communication between the discharge-side circular arc groove 440 and the intake-side circular arc groove 430, and are formed in a section extending across the x axis (refer to FIG. 3).

[Backpressure Ports]

The backpressure ports 45 and 46 in communication with bases of the vanes 7 (the backpressure chambers br and the slit proximal end portions 610) are formed on the plate 41 so as to be spaced apart from each other as the intake side and the discharge side (refer to FIG. 3).

[Intake-Side Backpressure Port](Refer to FIG. 3)

The intake-side backpressure port 45 is a port that establishes communication between the backpressure chambers br of the plurality of vanes 7 located in most of the intake region and the intake port 43. The vanes 7 "located in the intake region" mean that the vane distal end portions 70 of the vanes 7 are in alignment with the intake port 43 (the intake-side circular arc groove 430) as viewed from the z axis direction. The intake-side backpressure port 45 includes an intake-side backpressure circular arc groove 450 and an intake hole 451.

The intake-side backpressure circular arc groove 450 is formed on the surface 410 of the plate 41, and is a groove through which the pump intake-side hydraulic pressure is introduced. The intake-side backpressure circular arc groove 450 is formed into a substantially circular arc shape extending about the rotational axis O along an arrangement of the backpressure chambers br of the vanes 7 (the slit proximal end portions 610 of the rotor 6). The intake-side backpressure circular arc groove 450 is formed over a range of an angle corresponding to approximately three pitches (a range narrower than the intake-side circular arc groove 430).

A start end a of the intake-side backpressure circular arc groove 450 is located slightly on the rotational direction side with respect to the start end A of the intake-side circular arc groove 430 (the notch 434) and adjacent to an end of the main body start end portion 433 in the rotational direction. A terminal end b of the intake-side backpressure circular arc groove 450 is located away from the terminal end B of the intake-side circular arc groove 430 by an angle corresponding to approximately 1.5 pitches in the rotational negative direction. The intake-side backpressure circular arc groove 450 is formed in such a manner that a dimension (a groove width) of the intake-side backpressure circular arc groove 450 in the rotor radial direction is substantially constant over a whole range in the rotational direction, and is substantially equal to the intake-side circular arc groove 430 and the dimensions of the slit proximal end portions 610 in the rotor radial direction.

An edge 454 of the intake-side backpressure circular arc groove 450 on the rotor inner diameter side is located slightly on the rotor inner diameter side with respect to edges of the slit proximal end portions 610 on the rotor inner diameter side. An edge 455 of the intake-side backpressure circular arc groove 450 on the rotor outer diameter side is located slightly on the rotor inner diameter side with respect to edges of the slit proximal end portions 610 on the rotor outer diameter side. The intake-side backpressure circular arc groove 450 is formed at a position in the rotor radial direction that allows most of the intake-side backpressure circular arc groove 450 to be in alignment with the slit proximal end portions 610 (the backpressure chambers br) as viewed from the z axis direction, and is in communication with the slit proximal end portions 610 (the backpressure chambers br) when being in alignment with them, regardless of the eccentric position of the cam ring 8.

The intake hole 451 is opened at the intake-side backpressure circular arc groove 450 at a position located in the rotational negative direction (closer to the start end a) that allows the intake hole 451 to be in alignment with the intake hole 432 of the intake-side circular arc groove 430 in the rotor radial direction. The intake hole 451 is substantially oval as viewed from the z axis direction, and has a substantially equal width in the rotor radial direction to the intake-side backpressure circular arc groove 450 and a length of approximately one pitch in the rotational direction. The intake hole 451 is formed so as to extend through the plate 41 in the z axis direction, and is in communication with the intake hole 432 of the intake-side circular arc groove 430 via a low pressure chamber 491 of the rear body 40, which will be described below.

A start end portion 452 is formed between the start end a to the intake hole 451 in the intake-side backpressure circular arc groove 450. A tip of the start end portion 452 is formed into a substantially semicircular arc shape protruding in the rotational negative direction as viewed from the z axis. A terminal end portion 453 of the intake-side backpressure circular arc groove 450 is formed into a substantially semicircular arc shape protruding in the rotational direction. A depth of the start end portion 452 (in the z axis direction) is slightly shallower than 40% of the thickness of the plate 41, and a depth of the terminal end portion 453 is slightly shallower than 20% of the thickness of the plate 41. A slope is formed in a section from the terminal end portion 453 to the intake hole 451 so as to be gradually deepened toward the intake hole 451 in the rotational negative direction to have the equal depth to the thickness of the plate 41 at the intake hole 451.

[Discharge-Side Backpressure Port](Refer to FIG. 3)

The discharge-side backpressure port 46 is a port that establishes communication between the discharge port 44 and the backpressure chambers br of the plurality of vanes 7 located in most of the discharge region, the first confining region, and the second confining region, and a part of the intake region. The vanes 7 "located in the discharge region and the like" mean that the vane distal end portions 70 of the vanes 7 are in alignment with the discharge port 44 (the discharge-side circular arc groove 440) and the like as viewed from the z axis direction. The discharge-side backpressure port 46 includes a discharge-side backpressure circular arc groove 460 and a communication hole 461.

The discharge-side backpressure circular arc groove 460 is formed on the surface 410 of the plate 41, and is a groove through which the pump discharge-side hydraulic pressure is introduced. The discharge-side backpressure circular arc groove 460 is formed into a substantially circular arc shape extending about the rotational axis O along the arrangement of the backpressure chambers br of the vanes 7 (the slit proximal end portions 610). The discharge-side backpressure circular arc groove 460 is formed over a range of an angle corresponding to approximately seven pitches (a range wider than the discharge-side circular arc groove 440).

The discharge-side backpressure circular arc groove 460 is formed so as to reach even the intake region, and a start end c of the discharge-side backpressure circular arc groove 460 is located on the rotational negative direction side with respect to the start end C of the discharge-side circular arc groove 440 beyond the second confining region, and is located further on the rotational negative direction side with respect to the terminal end B of the intake-side circular arc groove 430. The start end c is located away from the terminal end B by approximately one pitch (corresponding to 2β).

A terminal end d of the discharge-side backpressure circular arc groove 460 is located away from the terminal end D of the discharge-side circular arc groove 440 by an angle slightly smaller than one pitch in the rotational direction, and is located close to a terminal end portion of the first confining region. The discharge-side backpressure circular arc groove 460 is formed in such a manner that a dimension (groove width) thereof in the rotor radial direction is substantially constant over a whole range in the rotational direction, and is slightly smaller than the discharge-side circular arc groove 440 and the dimensions of the slit proximal end portions 610 in the rotor radial direction.

An edge 464 of the discharge-side backpressure circular arc groove 460 on the rotor inner diameter side is located slightly on the rotor outer diameter side with respect to the edges of the slit proximal end portions 610 on the rotor inner diameter side. An edge 465 of the discharge-side backpressure circular arc groove 460 on the rotor outer diameter side is located slightly on the rotor inner diameter side with respect to the edges of the slit proximal end portions 610 on the rotor outer diameter side. The discharge-side backpressure circular arc groove 460 is formed at a position in the rotor radial direction that allows most of the discharge-side backpressure circular arc groove 460 to be in alignment with the slit proximal end portions 610 (the backpressure chambers br) as viewed from the z axis direction, and is in communication with the slit proximal end portions 610 (the backpressure chambers br) when being in alignment with them, regardless of the eccentric position of the cam ring 8.

The communication hole 461 is opened at the discharge-side backpressure circular arc groove 460 at a position located in the rotational negative direction (closer to the start end c). The communication hole 461 is located on a start end side of the second confining region at an angular position between the terminal end B of the intake-side circular arc groove 430 and the x axis (a middle point of the second confining region). A diameter of the communication hole 461 is substantially equal to the width of the discharge-side backpressure circular arc groove 460 in the rotor radial direction. The communication hole 461 is formed so as to extend through the plate 41 obliquely to the z axis direction in such a manner that its position is getting closer to the rotor outer diameter as the communication hole 461 extends in the negative direction of the z axis in the plate 41. The communication hole 461 is opened at a surface of the first plate 41 on the negative direction side of the z axis, and is in communication with the discharge hole 441 of the discharge port 44 (the discharge-side circular arc groove 440) via a high pressure chamber 492 of the rear body 40, which will be described below. The discharge-side backpressure circular arc groove 460 includes a start end portion 462 and a backpressure port main body portion 468.

[Details of Rear Body]

Figure 4:
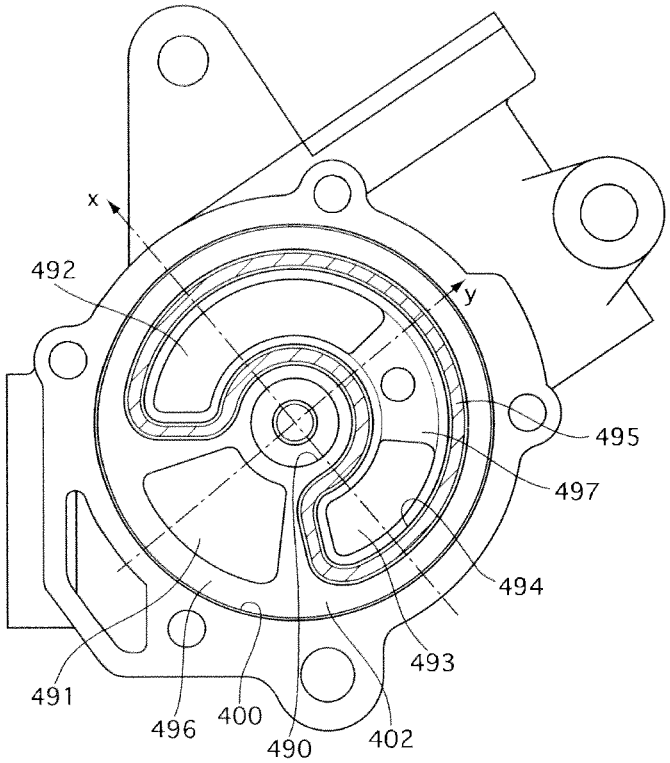
FIG. 4 illustrates a rear body according to the first embodiment as viewed from the positive direction of the z axis.

FIG. 4 illustrates the rear body 40 as viewed from the positive direction of the z axis. A containing hole 490, the low pressure chamber 491, the high pressure chamber 492, and a discharge chamber 493 are formed at the bottom portion 402 of the rear body 40.

The driving shaft 5 is inserted and is rotatably mounted in the containing hole 490. The low pressure chamber 491 is formed at the bottom portion 402 in a recessed manner. An opening portion of this low pressure chamber 491 is formed so as to cover opening portions on the negative direction side of the z axis of the intake holes 431 and 432 of the intake port 43 and the intake hole 451 of the intake-side backpressure port 45 formed on the plate 41. In other words, the intake port 43 and the intake-side backpressure port 45 are in communication with each other via the low pressure chamber 491, and the intake pressure is applied to the intake port 43 and the intake-side backpressure port 45.

The high pressure chamber 492 is formed at the bottom portion 402 in a recessed manner. An opening portion of this high pressure chamber 492 is formed so as to cover opening portions on the negative direction side of the z axis of the discharge hole 441 of the discharge port 44 and the discharge hole 461 of the discharge-side backpressure port 46 formed on the plate 41. In other words, the discharge port 44 and the discharge-side backpressure port 46 are in communication with each other via the high pressure chamber 492, and the discharge pressure is applied to the discharge port 44 and the discharge-side backpressure port 46.

In the present embodiment, the vane pump 1 is configured in such a manner that the intake pressure is applied to the intake-side backpressure port 45 and the discharge pressure is applied to the discharge-side backpressure port 46, but may be configured in such a manner that the discharge pressure is applied to both the intake-side backpressure port 45 and the discharge-side backpressure port 46.

The discharge chamber 493 is formed at the bottom portion 402 in a recessed manner. An opening portion of this discharge chamber 493 is formed so as to cover an opening portion of the discharge hole 442 of the discharge port 44 formed on the plate 41 on the negative direction side of the z axis. This discharge chamber 493 is in communication with a discharge passage 65 (refer to FIG. 2), and high-pressure hydraulic oil is discharged from this discharge passage 65.

Further, a seal groove 494 is formed so as to surround outer circumferences of the high pressure chamber 492 and the discharge chamber 493. A seal member 495 is disposed in this seal groove 494. When the plate 41 is mounted with the surface of the plate 41 on the negative direction side of the z axis facing the bottom portion 402 of the rear body 40, the seal member 495 is compressed in the z axis direction to be placed into close contact with the surface of the plate 41 on the negative direction side of the z axis, thereby maintaining the high pressure chamber 492 and the discharge chamber 493 in a liquid-tight state. A low pressure region 496 outside the seal member 495 and a high pressure region 497 inside the seal member 495 are defined by the seal member 495.

[Details of Front Body]

Figure 5:
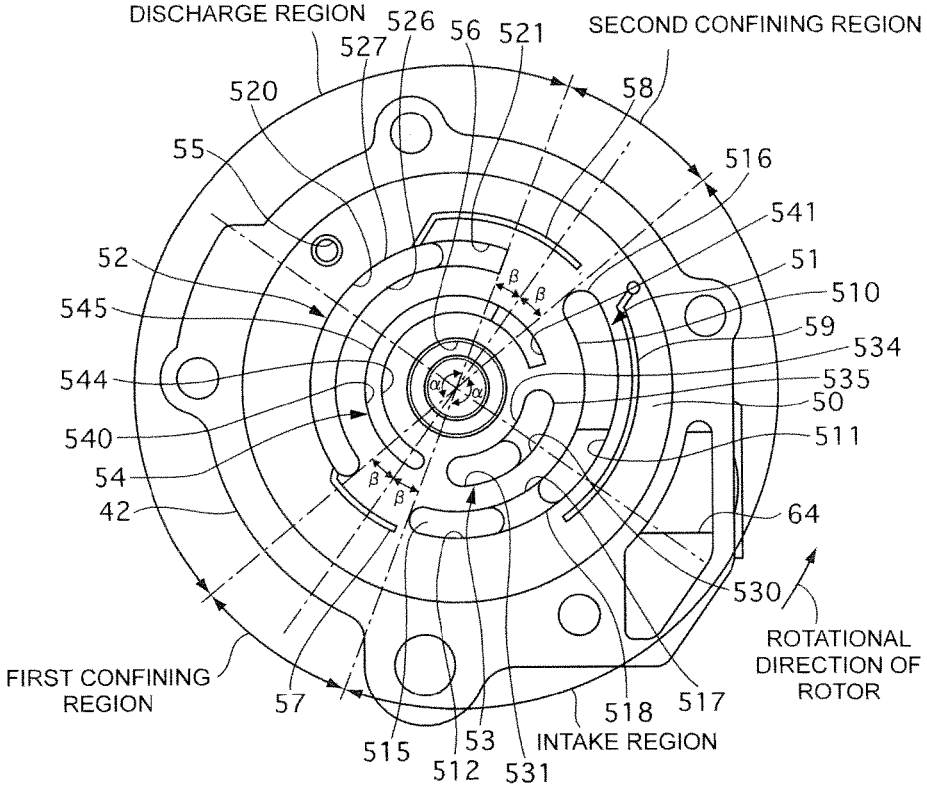
FIG. 5 illustrates a front body according to the first embodiment as viewed from a negative direction of the z axis.

FIG. 5 illustrates the front body 42 as viewed from the negative direction of the z axis.

The front body 42 includes a plate surface 50 protruding in the negative direction of the z axis. The plate surface 50 includes an intake port 51, a discharge port 52, an intake-side backpressure port 53, a discharge-side backpressure port 54, a pin mounting hole 55, and a through-hole 56. The seal pin 10 is inserted in the pin mounting hole 55, and is fixedly mounted therein. The driving shaft 5 is inserted in the through-hole 56, and is rotatably mounted therein. The intake port 51, the discharge port 52, the intake-side backpressure port 53, and the discharge-side backpressure port 54 are formed at positions corresponding to the intake port 43, the discharge port 44, the intake-side backpressure port 45, and the discharge-side backpressure port 46 formed on the plate 41.

[Configuration of Intake Port](Refer to FIG. 5)

The intake port 51 is in communication with the intake-side pump chambers r, and is formed in the section located on the negative direction side of the y axis where the pump chambers r have increasing volumes as the rotor 6 rotates. The intake port 51 includes an intake-side circular arc groove 510 and intake holes 511 and 512. The intake-side circular arc groove 510 is formed into a substantially circular arc shape extending about the rotational axis O along the arrangement of the intake-side pump chambers r.

A terminal end portion 516 of the intake-side circular arc groove 510 is formed into a substantially semicircular arc shape protruding in the rotational direction. A start end portion 515 of the intake-side circular arc groove 510 is formed into a semicircular arc shape protruding in the rotational negative direction. The intake-side circular arc groove 510 is formed so as to have a substantially constant width in the rotor radial direction over a whole range in the rotational direction.

An edge 517 of the intake-side circular arc groove 510 on the rotor inner diameter side is located slightly on the rotor outer diameter side with respect to the rotor outer circumferential surface 60 (except for the protrusions 62). An edge 518 of the intake-side circular arc groove 510 on the rotor outer diameter side is located slightly on the rotor outer diameter side with respect to the cam ring inner circumferential surface 80 of the cam ring 8 located at the minimum eccentric position. A terminal end side of the edge 518 is located slightly on the rotor outer diameter side with respect to the cam ring inner circumferential surface 80 of the cam ring 8 located at the maximum eccentric position. The respective intake-side pump chambers r are in alignment with the intake-side circular arc groove 510 as viewed from the z axis direction, and are in communication with the intake-side circular arc groove 510, regardless of the eccentric position of the cam ring 8.

The intake hole 511 is opened at the intake-side circular arc groove 510 from a terminal end portion to around a central portion of the intake-side circular arc groove 510 in the rotational direction. The intake hole 511 has a substantially equal width in the rotor radial direction to the intake-side circular arc groove 510, and a length of approximately three pitches in the rotational direction. The intake hole 511 is connected to an intake passage 64 formed at the front body 42, and the hydraulic oil is supplied from this intake passage 64.

The intake hole 512 is opened at the intake-side circular arc groove 510 at a position adjacent to the intake hole 511 on the terminal end side in the rotational direction. The intake hole 512 has a substantially equal width in the rotor radial direction to the intake-side circular arc groove 510, and a length of approximately one pitch in the rotational direction. The intake hole 512 is also connected to the intake passage 64 formed at the front body 42.

[Configuration of Discharge Port](Refer to FIG. 5).

The discharge port 52 is formed in the section located on the positive direction side of the y axis where the pump chambers r have decreasing volumes as the rotor 6 rotates. The discharge port 52 includes a discharge-side circular arc groove 520 having a notch 521. The discharge-side circular arc groove 520 is formed into a substantially circular arc shape extending about the rotational axis O along the arrangement of the discharge-side pump chambers r.

The discharge-side circular arc groove 520 is formed in such a manner that a width thereof in the rotor radial direction is substantially constant over a whole range in the rotational direction, and is slightly narrower than the width of the intake-side circular arc groove 510 in the rotor radial direction. An edge 526 of the discharge-side circular arc groove 520 on the rotor inner diameter side is located slightly on the rotor outer diameter side with respect to the rotor outer circumferential surface 60 (except for the protrusions 62). An edge 527 of the discharge-side circular arc groove 520 on the rotor outer diameter side is substantially in alignment with the cam ring inner circumferential surface 80 of the cam ring 8 located at the minimum eccentric position. The respective discharge-side pump chambers r are in alignment with the discharge-side circular arc groove 520 as viewed from the z axis, and are in communication with the discharge-side circular arc groove 520, regardless of the eccentric position of the cam ring 8.

The notch 521 is formed at an end of the discharge-side circular arc groove 520 in the rotational negative direction. This notch 521 is formed so as to be shallower than the discharge-side circular arc groove 520.

An end of the discharge-side circular arc groove 520 in the rotational positive direction is formed into a substantially semicircular shape protruding toward the rotational positive direction. Further, a portion of the discharge-side circular arc groove 520 on the rotational negative direction side which is a boundary with the notch 521 is formed into a substantially semicircular shape protruding toward the rotational negative direction. Further, an edge of the notch 521 in the rotational negative direction is formed into a rectangular shape.

[Configuration of Intake-Side Backpressure Port](Refer to FIG. 5)

The backpressure ports 53 and 54 in communication with the bases of the vanes 7 (the backpressure chambers br and the slit proximal end portions 610) are formed on the plate surface 50 so as to be spaced apart from each other as the intake side and the discharge side. The intake-side backpressure port 53 is a port that is located in most of the intake region and establishes communication between the backpressure chambers br of the plurality of vanes 7 and the intake port 51. The intake-side backpressure port 53 includes an intake-side backpressure circular arc groove 530 and an intake hole 531.

The intake-side backpressure circular arc groove 530 is formed into a substantially circular arc shape extending about the rotational axis O along the arrangement of the backpressure chambers br of the vanes 7 (the slit proximal end portions 610 of the rotor 6). The intake-side backpressure circular arc groove 530 is formed over a range of an angle corresponding to approximately three pitches (a range narrower than the intake-side circular arc groove 510).

The intake-side backpressure circular arc groove 530 is formed in such a manner that a dimension (groove width) thereof in the rotor radial direction is substantially constant over a whole range in the rotational direction, and is substantially equal to the intake-side circular arc groove 510 and the dimensions of the slit proximal end portions 610 in the rotor radial direction.

An edge 534 of the intake-side backpressure circular arc groove 530 on the rotor inner diameter side is located slightly on the rotor inner diameter side with respect to the edges of the slit proximal end portions 610 on the rotor inner diameter side. An edge 535 of the intake-side backpressure circular arc groove 530 on the rotor outer diameter side is located slightly on the rotor inner diameter side with respect to the edges of the slit proximal end portions 610 on the rotor outer diameter side. The intake-side backpressure circular arc groove 530 is located at a position in the rotor radial direction that allows most of the intake-side backpressure circular arc groove 530 to be in alignment with the slit proximal end portions 610 (the backpressure chambers br) as viewed from the z axis direction, and is in communication with the slit proximal end portions 610 (the backpressure chambers br) when being in alignment with them, regardless of the eccentric position of the cam ring 8.

The intake hole 531 is opened at the intake-side backpressure circular arc groove 530 at a position located in the rotational negative direction to allow the intake hole 531 to be in alignment with the intake hole 512 of the intake-side circular arc groove 510 in the rotor radial direction. The intake hole 531 is substantially oval as viewed from the z axis, and had a substantially equal width in the rotor radial direction to the intake-side backpressure circular arc groove 530 and a length of approximately one pitch in the rotational direction.

Both ends of the intake-side backpressure circular arc groove 530 in the rotational direction are formed into substantially semicircular arc shapes protruding in the rotational direction as viewed from the z axis direction.

[Configuration of Discharge-Side Backpressure Port](Refer to FIG. 5)

The discharge-side backpressure port 54 includes a discharge-side backpressure circular arc groove 540 and an orifice groove 541.

The discharge-side backpressure circular arc groove 540 is formed into a substantially circular arc shape extending about the rotational axis O along the arrangement of the backpressure chambers r of the vanes 7 (the slit proximal end portions 610). The discharge-side backpressure circular arc groove 540 is formed over a range of an angle corresponding to approximately seven pitches (a range wider than the discharge-side circular arc groove 520).

The discharge-side backpressure circular arc groove 540 is formed so as to reach even the intake region. A start point of the discharge-side backpressure circular arc groove 540 is located in the rotational negative direction with respect to the start point of the discharge-side circular arc groove 520 beyond the second confining region, and is located further in the rotational negative direction with respect to the terminal point of the intake-side circular arc groove 510.

A terminal point of the discharge-side backpressure circular arc groove 540 is formed at a position even in the rotational direction with respect to the terminal point of the discharge-side circular arc groove 520, and is located close to the terminal end portion of the first confining region.

The discharge-side backpressure circular arc groove 540 is formed in such a manner that a dimension (groove width) thereof in the rotor radial direction is substantially constant over a whole range in the rotational direction, and is slightly smaller than the discharge-side circular arc groove 520 and the dimensions of the slit proximal end portions 610 in the rotor radial direction.

An edge 544 of the discharge-side backpressure circular arc groove 540 on the rotor inner diameter side is located slightly on the rotor outer diameter side with respect to the edges of the slit proximal end portions 610 on the rotor inner diameter side. An edge 545 of the discharge-side backpressure circular arc groove 540 on the rotor outer diameter side is located slightly on the rotor inner diameter side with respect to the edges of the slit proximal end portions 610 on the rotor outer diameter side. The discharge-side backpressure circular arc groove 540 is formed at a position in the rotor radial direction that allows most of the discharge-side backpressure circular arc groove 540 to in alignment with the slit proximal end portions 610 (the backpressure chambers r) as viewed from the z axis direction, and is in communication with the slit proximal end portions 610 (the backpressure chambers r) when being in alignment with them, regardless of the eccentric position of the cam ring 8.

An end of the discharge-side backpressure circular arc groove 540 in the rotational positive direction is formed into a substantially semicircular shape protruding toward the rotational positive direction. Further, a portion of the discharge-side backpressure circular arc groove 540 in the rotational negative direction that is a boundary with the orifice groove 541 is formed into a rectangular shape. Further, an edge of the orifice groove 541 in the rotational negative direction is formed into a rectangular shape.

[Lubricating Oil Groove](Refer to FIG. 5)

A lubricating oil groove 57 in communication with an outer circumferential side with respect to the intake port 51 and the discharge port 52 in the first confining region is formed at the end of the discharge-side circular arc groove 520 of the discharge port 52 in the rotational positive direction. Further, a lubricating oil groove 58 in communication with the outer circumferential side with respect to the intake port 51 and the discharge port 52 in the second confining region is formed at a portion of the discharge-side circular arc groove 520 in the rotational positive direction. The hydraulic oil is supplied from these lubricating oil grooves 57 and 58 into between the swingable cam ring 8 and the plate surface 50 as lubricating oil.

A lubricating oil groove 59 is formed along an outer circumference of the intake port 51. This lubricating oil groove 59 supplies the hydraulic oil in the first control chamber R1 of the control portion 3, which will be described below, into between the swingable cam ring 8 and the plate surface 50 via an lubricating oil intake hole 591 as the lubricating oil.

[Configuration of Control Portion](Refer to FIG. 2)

As main components, the control portion (a cam ring control mechanism) 3 includes a control valve 30, first and second passages 31 and 32, and the first and second control chambers R1 and R2. The control portion 3 changes volumes of the control chambers R1 and R2 by switching supply of the hydraulic oil from the discharge chamber 493 into the first passage 31 and the second passage 32 with use of the control valve 30. An operation of the control valve 30 is controlled by the CVT control unit 300 based on, for example, the number of rotations and an opening degree of a throttle valve of the internal combustion engine.

In the following, a configuration of the control portion 3 will be described further with reference to FIG. 6.

The control valve 30 is a valve that controls an entry and exit of the hydraulic fluid into and from the first control chamber R1 and the second control chamber R2, and includes a containing hole 401, a solenoid 301, a spool 302, and a coil spring 303. For convenience of the description, a w axis is set to an axial direction of the spool 302 assuming that the right side of the sheet of FIG. 6 is a positive direction thereof.

The containing hole 401 extends in the rear body 40 in the w axis direction, and includes a first increased-diameter portion 404, a second increased-diameter portion 405, and a spool containing portion 406 located in this order from a negative direction of the w axis to the positive direction of the w axis. The first increased-diameter portion 404 has a largest inner diameter, and the spool containing portion 406 has a smallest inner diameter.

The solenoid 301 is fixed to an opening edge of the containing hole 401, and is fixed to the rear body 40 with a case tip portion 305 of a solenoid case 304 inserted in the second increased-diameter portion 405. An annular seal member 407 is disposed between an outer circumferential surface 306 of the case tip portion 305 and the first increased-diameter portion 404. A case end surface 308 of the case tip portion 305 is formed flatly (into a flat surface), and extends perpendicularly to the w axis.

The solenoid case 304 includes a plunger 307 capable of being projected and inserted via an opening (not illustrated) formed on the case end surface 308. The plunger 307 does not operate when no power is supplied, and is projected according to a supplied power amount when power is supplied. In other words, a tip portion 309 of the plunger 307 is located inside the solenoid case 304 with respect to the case end surface 308 when no power is supplied, and is located outside the solenoid case 304 with respect to the case end surface 308 when power is supplied.

The spool 302 is contained in the spool containing portion 406 of the containing hole 401, and a first cylindrical portion 310, a first land portion 311, a second cylindrical portion 312, and a second land portion 313 are formed on an outer circumference of the spool 302 in this order from the negative direction to the positive direction of the w axis.

A one-side chamber 408, into which the hydraulic oil is introduced, is defined in a space between the first cylindrical portion 310, the spool containing portion 406, and the second increased-diameter portion 405. A first end surface 314, which is an end surface of the spool 302 adjacent to the first cylindrical portion 310, is in contact with the case end surface 308 of the solenoid case 304 when no power is supplied to the solenoid 301, and is in contact with the plunger 307 projected from the case end surface 308 when power is supplied to the solenoid 301. A shape of the first end surface 314 will be described below.

The first land portion 311 slidably moves in the spool containing portion 406 in the w axis direction, and establishes and cuts off communication between the first passage 31 formed in the rear body 40 and the one-side chamber 408.

The second land portion 313 slidably moves in the spool containing portion 406 in the w axis direction, and establishes and cuts off communication between the second passage 32 formed in the rear body 40 and an opposite-side chamber 409 defined between the spool 302 and a bottom surface 403 of the containing hole 401. A large-diameter hole 317, which contains a coil spring 303, is defined in a hole portion 316 adjacent to a second surface 315.

The coil spring 303 is mounted between the bottom surface 403 of the containing hole 401 and a stepped surface 318 of the spool 302 in a compressed state. The coil spring 303 biases the spool 302 in the negative direction of the w axis with a predetermined set load.

An upstream-side oil passage 65*a* and a downstream-side oil passage 65*b* are formed in a passage connecting the discharge chamber 493 and the discharge passage 65. The upstream-side oil passage 65*a* branches off on an upstream side of a metering orifice 700, and is connected to an upstream-side port 401*a*. The downstream-side oil passage 65*b* branches off on a downstream side of the metering orifice 700, and is connected to the downstream-side port 401*b*.

[Cam Support Surface]

Figure 7:
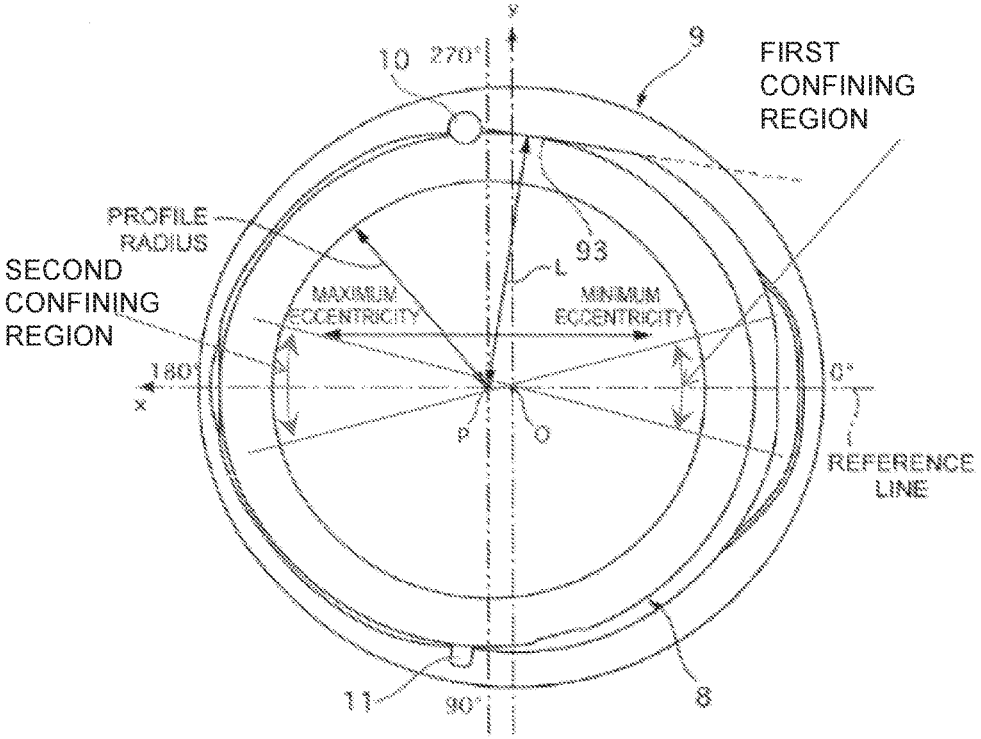
FIG. 7 illustrates a cam ring and an adapter ring according to the first embodiment as viewed from the direction along the rotational axis.

FIG. 7 illustrates the cam ring 8 and the adapter ring 9 according to the first embodiment as viewed from the rotational axis direction. Assume that the rotational direction of the rotor 6 (the rotational direction of the driving shaft 5) is a circumferential direction, a middle point between the start end A of the intake port 43 and the terminal end D of the discharge port 44 in the circumferential direction is defined as a reference point, and a line perpendicularly intersecting with the rotational axis O of the driving shaft 5 and passing through the reference point is defined as a reference line. In other words, the reference line is a line extending on the x axis.

In the first embodiment, the cam support surface 93 is formed so as to be located closer to the reference line as it extends from the positive direction side of the x axis toward the negative direction side of the x axis. In other words, the cam support surface 93 is formed in such a manner that a shortest distance L to the reference line decreases from the second confining region side toward the first confining region side.

[Cam Ring Profile]

Referring to FIG. 7, a distance between the central axis P of the cam ring 8 and the inner circumferential surface of the cam ring 8 is defined as a cam profile radius, and a change rate of the cam profile radius in the rotational direction of the driving shaft 5 is defined as a cam profile radius change rate. Then, a cam ring profile defining angle is defined in such a manner that zero degree as the cam ring profile defining angle is set to a point located on the first confining region side (located on the negative direction side of the x axis) that is one of a pair of points where the inner circumferential surface of the cam ring 8 intersects with the reference line (the x axis) when the cam ring 8 is placed in such a manner that the central axis P coincides with the rotational axis O, and respective points on the inner circumferential surface of the cam ring 8 have angles increasing along the inner circumferential surface of the cam ring 8 in the rotational direction of the driving shaft 5 so that the angle defined by one rotation throughout the inner circumferential surface of the cam ring 8 becomes 360 degrees.

Figure 8:
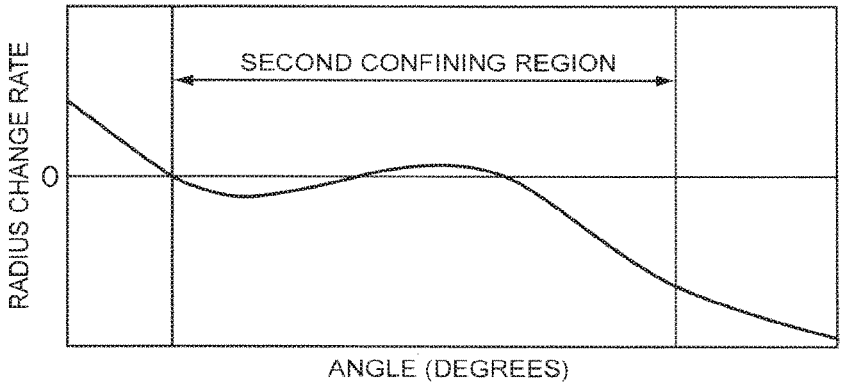
FIG. 8 illustrates a cam profile radius change rate with respect to a cam ring profile defining angle when an eccentric amount of the cam ring is maximized according to the first embodiment.

In this case, according to the first embodiment, the cam ring 8 is formed in such a manner that the cam profile radius change rate decreases first and then increases again on the second confining region side when the eccentric amount δ of the cam ring 8 is maximized, as illustrated in FIG. 8.

Next, a function of the vane pump 1 according to the first embodiment will be described.

[Function of Pump](Refer to FIG. 3)

When the rotor 6 rotates with the cam ring 8 placed eccentrically in the positive direction of the x axis with respect to the rotational axis O, the pump chambers r cyclically expand and contract while rotating about the rotational axis. The hydraulic oil is introduced from the intake port 43 into the pump chambers r on the negative direction side of the y axis where the pump chambers r expands along the rotational direction, and the introduced hydraulic oil is discharged from the pump chambers r into the discharge port 44 on the positive direction side of the y axis where the pump chambers r contract in the rotational direction.

More specifically, focusing on one of the pump chambers r, the volume of the pump chamber r increases in the intake region until the vane 7 located on the negative direction side of this pump chamber r in the rotational direction (hereinafter referred to as the back-side vane 7) passes through the terminal end B of the intake-side circular arc groove 430, i.e., until the vane 7 located on the positive direction side of the pump chamber 7 in the rotational direction (herein after referred to as the front-side vane 7) passes through the start end C of the discharge-side circular arc groove 440. During this time, the hydraulic oil is introduced from the intake port 43 into this pump chamber r since the pump chamber r is in communication with the intake-side circular arc groove 430.

In the second confining region, the pump chamber r is out of communication with both the intake-side circular arc groove 430 and the discharge-side circular groove 440, and therefore is maintained in a liquid-tight state when the pump chamber r is located at a rotational position where the back-side vane 7 (a surface thereof on the positive direction side in the rotational direction) of the pump chamber r is in alignment with the terminal end B of the intake-side circular arc groove 430 and the front-side vane 7 (a surface thereof on the negative direction side in the rotational direction) is in alignment with the start end C of the discharge-side circular arc groove 440.

After the back-side vane 7 of the pump chamber r passes through the terminal end B of the intake-side circular arc groove 430 (the front-side vane 7 passes through the start end C of the discharge-side circular arc groove 440), in the discharge region, the volume of the pump chamber r decreases according to the rotation and is in communication with the discharge-side circular arc groove 440, whereby the hydraulic oil is discharged from the pump chamber r into the discharge port 44.

In the first confining region, the pump chamber r is out of communication with both the discharge-side circular arc groove 440 and the intake-side circular arc groove 430 and therefore is maintained in a liquid-tight state when the pump chamber r is located at a position where the back-side vane 7 (the surface thereof on the positive direction side in the rotational direction) of the pump chamber r is in alignment with the terminal end D of the discharge-side circular arc groove 440 and the front-side vane 7 (the surface thereof on the negative direction side in the rotational direction) is in alignment with the start end A of the intake-side circular arc groove 430.

According to the first embodiment, each of the first confining region and the second confining region is set so as to have a range corresponding to one pitch (corresponding to a single pump chamber r), whereby the first embodiment can improve pump efficiency while preventing communication from being established between the intake region and the discharge region. The confining regions (the spaces between the intake port 43 and the discharge port 44) may be set so as to have a range wider than one pitch. In other words, the angular ranges of the confining regions may be arbitrarily set as long as these ranges can prevent communication from being established between the discharge region and the discharge region.

When the front-side vane 7 (the surface thereof on the negative direction side in the rotational direction) moves from the second confining region into the discharge region, the discharge port 44 and the pump chamber r are subject to only a reduced pressure change because the orifice effect of the start end portion 443 prevents communication from being suddenly established between the pump chamber r and the discharge-side circular arc groove 440. In other words, because the hydraulic oil is prevented from being suddenly introduced from the high-pressure discharge port 44 into the low-pressure pump chamber r, the first embodiment prevents a sudden reduction in a flow amount supplied into an external pipe connected from the discharge port 44 via the discharge hole 442. Therefore, the first embodiment can reduce a pressure change (oil hammer) in the pipe. Further, because the first embodiment can reduce a sudden increase in a flow amount supplied into the pump chamber r, the first embodiment can also reduce a pressure change in the pump chamber r. The start end portion 443 may be omitted as necessary.

Further, when the front-side vane 7 (the surface thereof on the negative direction side in the rotational direction) moves from the first confining region into the intake region, the intake port 43 and the pump chamber r are subject to only a reduced pressure change because the orifice effect of the notch 434 prevents communication from being suddenly established between the pump chamber r and the intake-side circular arc groove 430. In other words, the first embodiment prevents the volume of the pump chamber r from suddenly increasing to prevent the hydraulic oil from suddenly flowing out from the high-pressure pump chamber r into the low-pressure intake port 43, thereby succeeding in preventing or reducing generation of bubbles (cavitation). The notch 434 may be omitted as necessary.

Figure 6:
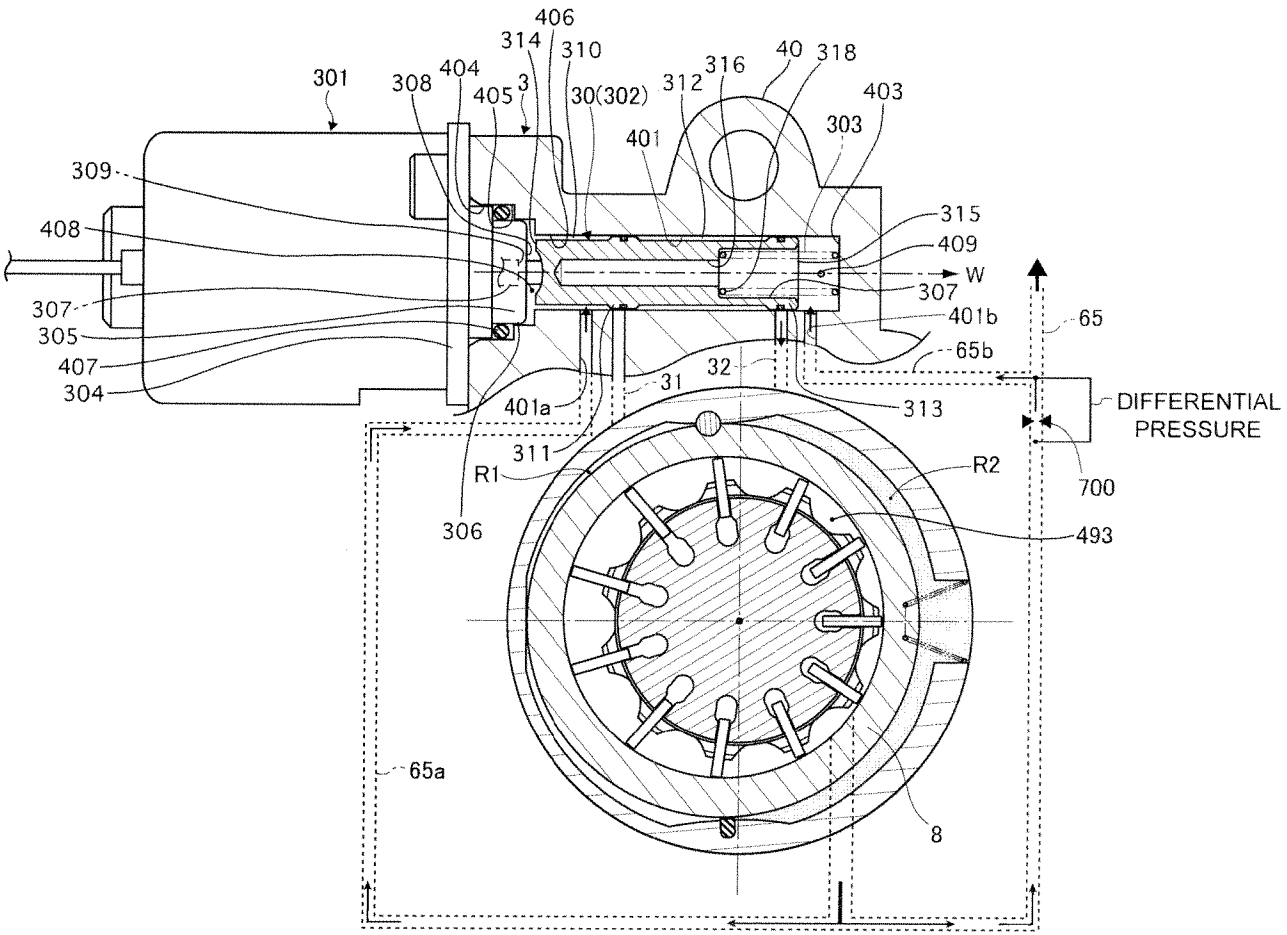
FIG. 6 illustrates a configuration of a control portion according to the first embodiment.
Figure 9:
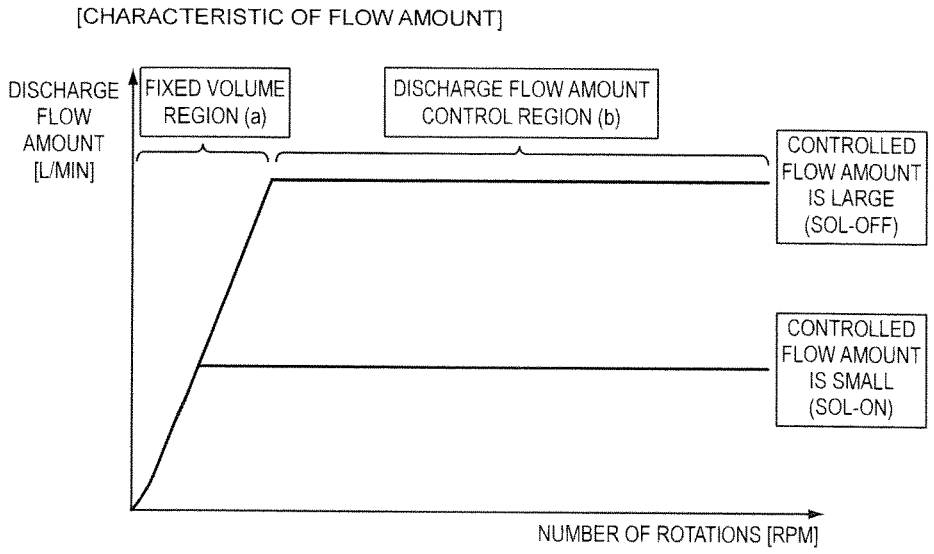
FIG. 9 is a characteristic diagram illustrating a relationship between the number of rotations and a discharged flow amount of the variable displacement vane pump according to the first embodiment.

[Function of Variable Displacement](Refer to FIGS. 6 and 9)

First, how the vane pump 1 operates when the solenoid 301 is out of operation will be described with reference to FIGS. 6 and 9. FIG. 9 is a characteristic diagram illustrating a relationship between the number of rotations and a discharge flow amount of the variable displacement vane pump 1 according to the first embodiment. The initial set load is applied to the spool 302 by the coil spring 303 in the negative direction of the w axis. When the flow amount is relatively small at an early stage of an operation of the pump, a differential pressure between the front and back of the metering orifice 700 is not so much high, and the spool 302 is biased by the load of the coil spring 303 in the negative direction of the w axis so that the first land portion 311 cuts off communication between the upstream-side port 401*a* and the first passage 31 while the second land portion 313 establishes communication between the downstream-side port 401*b* and the second passage 32. As a result, a discharge pressure is not supplied into the first control chamber R1 while a discharge pressure is supplied into the second control chamber R2, so that the cam ring 8 is eccentrically located and the pump discharge flow amount increases according to an increase in the number of rotations (refer to a fixed volume region (a) illustrated in FIG. 9).

As the pump discharge flow amount increases, this leads to an increase in the differential pressure between the upstream side and downstream side of the metering orifice 700, so that the spool 302 starts moving in the positive direction of the w axis when a force applied to the first land portion 311 in the positive direction of the w axis exceeds a sum of the initial set load of the coil spring 303 and a force applied to the second land portion 313 in the negative direction of the w axis. As a result, the first land portion 311 establishes the communication between the upstream-side port 401*a* and the first passage 31 while the second land portion 313 cuts off the communication between the downstream-side port 401*b* and the second passage 32. Therefore, a high discharge pressure on the upstream side of the metering orifice 700 is supplied into the first control chamber R1 while the discharge pressure stops being supplied into the second control chamber R2 so that the eccentric amount of the cam ring 8 decreases and the pump discharge flow amount does not increase even with an increase in the number of rotations of the pump. When the pump discharge flow amount excessively decreases, this leads to a reduction in the differential pressure between the upstream side and downstream side of the metering orifice 700 so that the cam ring 8 moves into an eccentric state again, resulting in an increase in the discharge flow amount as necessary (refer to a discharge flow amount control region (b) illustrated in FIG. 9).

[Function of Preventing or Reducing Surge Pressure and Cavitation Due to Normal Inclination of Cam Support Surface]

Normally, vane pumps for CVTs are used with more than a half thereof immersed in hydraulic oil in a transmission case. Then, in the transmission case, for example, a connecting chain or the like is in operation in an exposed state so that the hydraulic oil in the case is constantly stirred and therefore is characterized by an extremely large amount of bubbles contained in the hydraulic oil in the case. Accordingly, if the hydraulic oil is insufficiently compressed during a high-revolution operation, the bubbles may fail to be completely crushed and some of them may remain, leading to occurrence of cavitation. On the other hand, if the hydraulic oil is highly compressed during a low-revolution operation, this leads to a sudden pressure change in the discharge pressure, and a sudden pressure increase in the pump chambers, i.e., a so-called surge pressure.

With the aim of solving this drawback, according to the first embodiment, the cam support surface 93 of the adapter ring 9 is formed so as to have a so-called normal inclination in such a manner that it is located closer to the reference line from the positive direction side toward the negative direction side of the x axis. Therefore, the central axis P of the cam ring 8 moves in the negative direction in the y axis with respect to the reference line as the eccentric amount δ of the cam ring 8 decreases. In other words, as the number of rotations of the vane pump 1 increases, each pump chamber r starts compressing the hydraulic pressure (the volume of the pump chamber r starts decreasing) at an earlier timing compared to a timing when the front-side vane 7 reaches the start end C of the discharge port 44, whereby a compression rate can increase in the second confining region. As a result, as the number of rotations of the vane pump 1 increases, the hydraulic oil can be highly compressed, whereby the occurrence of the cavitation can be prevented or reduced during the high-revolution operation.

Further, according to the first embodiment, as the number of rotations of the vane pump 1 decreases, each pump chamber r starts compressing the hydraulic oil at a later timing, whereby the compression rate can decrease in the second confining region. As a result, as the number of rotations of the vane pump 1 deceases, the hydraulic oil can be lowly compressed, whereby the generation of the surge pressure can be prevented or reduced during the low-revolution operation.

[Function of Preventing or Reducing Surge Pressure Due to Cam Ring Profile]

According to the first embodiment, the cam ring 8 is formed in such a manner that the cam profile radius change rate decreases first and then increases again on the second confining region side when the eccentric amount δ of the cam ring 8 is maximized.

For a perfect circle cam having a perfect circle shape as the cam ring inner circumferential surface, in the second confining region, once the cam profile radius change rate starts decreasing, the cam profile radius change rate monotonously decreases with the hydraulic oil being compressed at an excessively high speed, which results in low effectiveness in preventing or reducing the surge pressure when the eccentric amount of the cam ring is maximize, i.e., during the low-revolution operation.

On the other hand, according to the first embodiment, because the cam profile radius change rate shifts to an increase again although it starts decreasing first, whereby the first embodiment can slow down the compression speed compared to the above-described perfect circle cam, thereby preventing or reducing the surge pressure during the low-revolution operation.

The variable displacement vane pump according to the first embodiment has the following effect.

(1) The variable displacement vane pump according to the first embodiment includes the body 4 (the rear body 40, the plate 41, and the front body 42) including the pump element containing portion, the driving shaft 5 rotatably supported by the body 4, the rotor 6 disposed in the body 4, configured to be rotatably driven by the driving shaft 5, and including the plurality of slits 61 in the circumferential direction, the plurality of vanes 7 disposed so as to be able to be projected from and inserted into the slits 61, the cam support surface 93 formed on the inner circumferential side of the pump element containing portion, the cam ring 8 disposed movably as if it rolls on the cam support surface 93 in the pump element containing portion, annularly formed, and defining the plurality of pump chambers r on the inner circumferential side thereof together with the rotor 6 and the vanes 7, the intake port 43 formed at the body 4 so as to be opened in the intake region of the plurality of pump chambers r, which region is a region where volume thereof increases as the rotor 6 rotates, and disposed opposite of the driving shaft 5 from the cam support surface 93, the discharge port 44 formed at the body 4 so as to be opened in the discharge region of the plurality of pump chambers r, which region is a region where volume thereof decreases as the rotor 6 rotates, and disposed closer to the cam support surface 93 with respect to the driving shaft 5, and the control portion 3 disposed at the body 4 and configured to control the eccentric amount δ of the cam ring 8 with respect to the rotor 6. Assume that the respective terms mean the following definitions. The start end A of the intake port 43 is the point where one of the vanes 7 is placed into alignment with the intake port 43 for the first time after moving away from the discharge region as the rotor 6 rotates. The terminal end B of the intake port 43 is the point where one of the vanes 7 is in alignment with the intake port 43 for the last time in the intake region as the rotor 6 rotates. The start end C of the discharge port 44 is the point where one of the vanes 7 is placed into alignment with the discharge port 44 for the first time after moving away from the intake region as the rotor 6 rotates. The terminal end D of the discharge port 44 is the point where one of the vanes 7 is in alignment with the discharge port 44 for the last time in the discharge region as the rotor 6 rotates. The first confining region is the region between the terminal end D of the discharge port 44 and the start end A of the intake port 43. The second confining region is the space between the terminal end B of the intake port 43 and the start end C of the discharge port 44. The circumferential direction is the rotational direction of the driving shaft 5. The reference point is the middle point between the start end A of the intake port 43 and the terminal end D of the discharge port 44 in the circumferential direction. The reference line is the line perpendicularly intersecting with the rotational axis of the driving shaft 5 and passing through the reference point. The cam profile radius is the distance between the center P of the inner circumferential surface of the cam ring 8 and the inner circumferential surface of the cam ring 8. The cam profile radius change rate is the change rate of the cam profile radius in the rotational direction of the driving shaft 5. The cam ring profile defining angle is defined in such a manner that, when the cam ring 8 is placed in such a manner that the center P of the inner circumferential surface of the cam ring 8 coincides with the rotational axis O of the driving shaft 5, the angle of 0 degree as the cam ring profile defining angle is set to the one of the pair of points intersecting with the reference line that is located on the first confining region side among the points on the inner circumferential surface of the cam ring 8, and the respective points on the inner circumferential surface of the cam ring 8 have angles increasing along the inner circumferential surface of the cam ring 8 in the rotational direction of the driving shaft 5 so that the angle defined by one rotation throughout the inner circumferential surface of the cam ring 8 becomes 360 degrees. In this case, the cam support surface 93 is formed in such a manner that the shortest distance L between the cam support surface 93 and the reference line decreases from the second confining region side toward the first confining region side, and the cam ring 8 is formed in such a manner that the cam profile radius change rate decreases first and then increases again on the second confining region side when the eccentric amount δ of the cam ring 8 is maximized.

Therefore, because the cam support surface 93 has the so-called normal inclination, the first embodiment can reduce the compression rate in the second confining region when the eccentric amount of the cam ring is maximized, thereby preventing or reducing the surge pressure during the low-revolution operation, and can increase the compression rate in the second confining region when the eccentric amount of the cam ring is minimized, thereby preventing or reducing the occurrence of the cavitation during the high-revolution operation. Further, since the cam profile radius change rate shifts to an increase again although it starts decreasing first, the first embodiment can slow down the compression speed when the eccentric amount is maximized, thereby preventing or reducing the surge pressure during the low-revolution operation.

[Second Embodiment]

Figure 10:
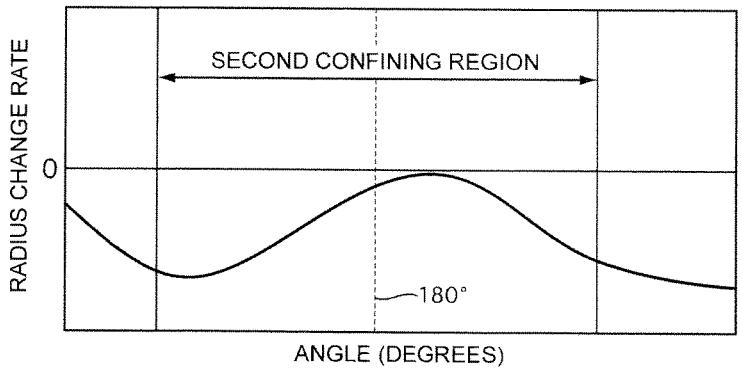
FIG. 10 illustrates the cam profile radius change rate with respect to the cam ring profile defining angle when the eccentric amount of the cam ring is minimized according to a second embodiment.

FIG. 10 illustrates the cam profile radius change rate with respect to the cam ring profile defining angle when the eccentric amount of the cam ring is minimized according to a second embodiment.

As illustrated in FIG. 10, the second embodiment is different from the first embodiment in terms of the cam ring 8 formed in such a manner that the cam profile radius change rate has a negative value at a point corresponding to the cam ring profile defining angle of 180 degrees when the eccentric amount δ of the cam ring 8 is minimized.

Now, a function of the second embodiment will be described.

If the cam ring 8 is formed in such a manner that the cam profile radius change rate decreases first and then increases again on the second confining region side when the eccentric amount of the cam ring is minimized, the hydraulic oil may be compressed insufficiently to fail to prevent or reduce the occurrence of the cavitation during the high-revolution operation because the compression rate decreases or the expansion rate increases on the second confining region side as the eccentric amount δ decreases.

Therefore, according to the second embodiment, the cam ring 8 is formed in such a manner that the cam profile radius change rate has a negative value, i.e., the hydraulic oil is subjected to a compression process at the point corresponding to the cam ring profile defining angle of 180 degrees when the eccentric amount δ of the cam ring 8 is minimized, whereby the second embodiment can reduce a reduction in the compression rate during the high-revolution operation, thereby preventing or reducing the cavitation.

The variable displacement vane pump according to the second embodiment has the following effect in addition to the effect (1) of the first embodiment.

(2) The cam ring 8 is formed in such a manner that the cam profile radius change rate has a negative value at the point corresponding to the cam ring profile defining angle of 180 degrees when the eccentric amount δ of the cam ring 8 is minimized Therefore, the second embodiment can prevent or reduce the cavitation during the high-revolution operation.

[Third Embodiment]

Figure 11:
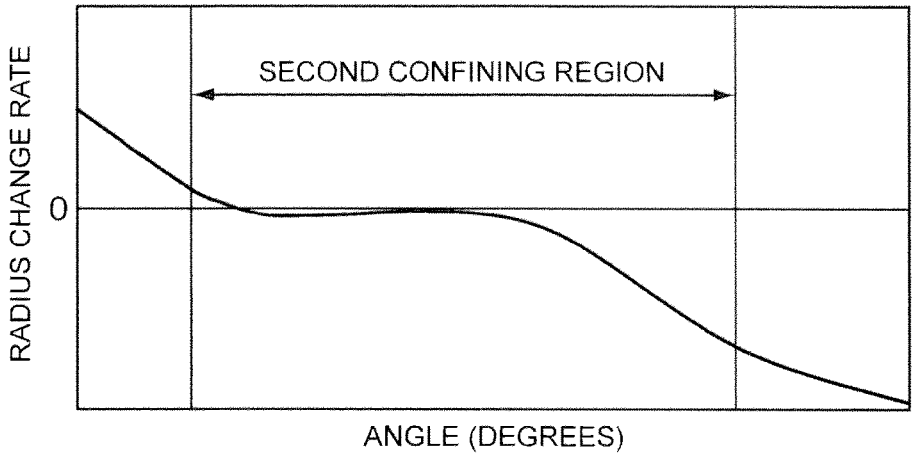
FIG. 11 illustrates the cam profile radius change rate with respect to the cam ring profile defining angle when the eccentric amount of the cam ring is minimized according to a third embodiment.

FIG. 11 illustrates the cam profile radius change rate with respect to the cam ring profile defining angle when the eccentric amount of the cam ring is minimized according to a third embodiment.

As illustrated in FIG. 11, the third embodiment is different from the second embodiment in terms of the cam ring 8 formed in such a manner that the cam profile radius change rate has a negative value as a maximum value thereof when the cam profile radius change rate increases again after decreasing first on the second confining region side when the eccentric amount δ of the cam ring 8 is minimized.

Now, a function of the third embodiment will be described.

Because an increase in the maximum value when the cam profile radius change rate increases again leads to an increase in the expansion rate when the eccentric amount δ is small, the third embodiment can reduce the expansion when the eccentric amount δ is small by being configured in such a manner that the cam profile radius change rate has a negative value as this maximum value, resulting in preventing or reducing the cavitation during the high-revolution rotation.

The variable displacement vane pump according to the third embodiment has the following effect in addition to the effect (2) of the second embodiment.

(3) The cam ring 8 is formed in such a manner that the cam profile radius change rate has a negative value as the maximum value when the cam profile radius change rate increases again after decreasing first on the second confining region side when the eccentric amount δ of the cam ring 8 is minimized.

Therefore, the third embodiment can prevent or reduce the cavitation during the high-revolution operation.

[Fourth Embodiment]

Figure 12:
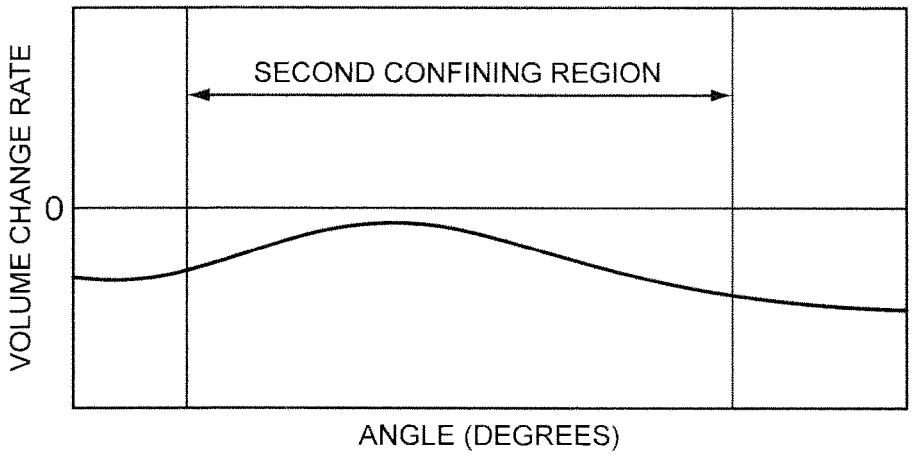
FIG. 12 illustrates a volume change rate with respect to the cam ring profile defining angle when the eccentric amount of the cam ring is minimized according to a fourth embodiment.

FIG. 12 illustrates a volume change rate with respect to the cam ring profile defining angle when the eccentric amount of the cam ring is minimized according to a fourth embodiment. The cam profile defining angle for the volume change rate is determined based on the angle of the back-side vane 7.

As illustrated in FIG. 12, the fourth embodiment is different from the second embodiment in terms of the cam ring 8 formed in such a manner that the volume change rate decreases first and then increases again, and has a negative value as a maximum value when the volume change rate increases again in this manner on the second confining region side when the eccentric amount δ of the cam ring 8 is minimized, assuming that the volume change rate means a volume change rate of each pump chamber r in the rotational direction of the driving shaft 5.

Now, a function of the fourth embodiment will be described.

According to the fourth embodiment, the volume change rate has a negative value when increasing again in a similar manner to the radius change rate. Therefore, the fourth embodiment can prevent or reduce the expansion when the eccentric amount δ is small, resulting in preventing or reducing the cavitation during the high-revolution operation.

The variable displacement vane pump according to the fourth embodiment has the following effect in addition to the effect (2) of the second embodiment.

(4) The cam ring 8 is formed in such a manner that the volume change rate decreases first and then increases again, and has a negative value as the maximum value when the volume change rate increases again in this manner on the second confining region side when the eccentric amount δ of the cam ring 8 is minimized, assuming that the volume change rate means the volume change rate of each of the plurality of pump chamber r in the rotational direction of the driving shaft 5.

Therefore, the fourth embodiment can prevent or reduce the cavitation during the high-revolution operation.

[Fifth Embodiment]

Figure 13:
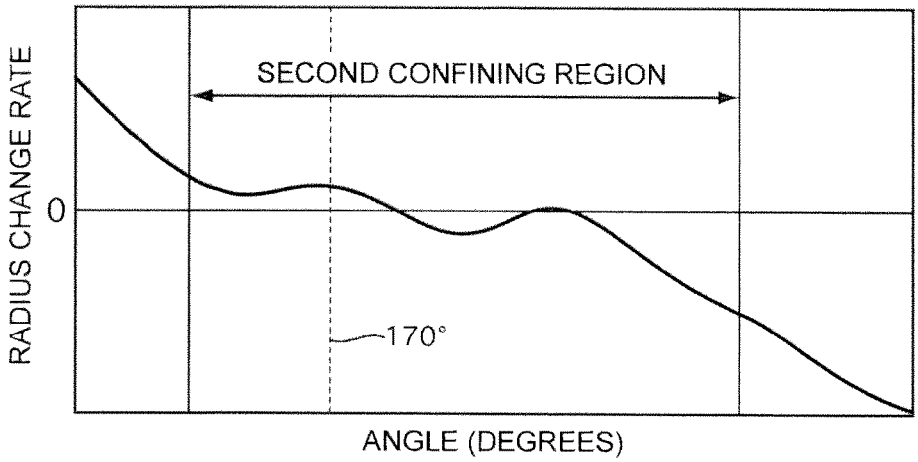
FIG. 13 illustrates the cam profile radius change rate with respect to the cam ring profile defining angle when the eccentric amount of the cam ring is maximized according to a fifth embodiment.

FIG. 13 illustrates the cam profile radius change rate with respect to the cam ring profile defining angle when the eccentric amount of the cam ring is maximized according to a fifth embodiment.

As illustrated in FIG. 13, the fifth embodiment is different from the second embodiment in terms of the cam ring 8 formed in such a manner that the cam profile radius change rate decreases first, then increases, then decreases again after that, then increases again after that, and then decreases again after that on the second confining region side when the eccentric amount of the cam ring is maximized. Further, as illustrated in FIG. 13, according to the fifth embodiment, the cam ring 8 is formed in such a manner that the cam profile radius change rate has a positive value as a minimum value in one (the first one) of the two reductions of the cam profile radius change rate on the second confining region side when the eccentric amount of the cam ring is maximized.

Now, a function of the fifth embodiment will be described.

According to the fifth embodiment, the cam profile radius change rate shifts to an increase twice although it starts decreasing first. Therefore, the fifth embodiment can slow down the compression speed and the expansion speed, thereby preventing or reducing the surge pressure during the low-revolution operation.

Further, the cam profile radius change rate has a positive value as the minimum value in one of the two reductions thereof, whereby the fifth embodiment can slow down the compression speed, thereby preventing or reducing the surge pressure during the low-revolution operation.

The variable displacement vane pump according to the fifth embodiment has the following effects in addition to the effect (2) of the second embodiment.

(5) The cam ring 8 is formed in such a manner that the cam profile radius change rate decreases first, then increases, then decreases again after that, then increases again after that, and then decreases again after that on the second confining region side.

Therefore, the fifth embodiment can prevent or reduce the surge pressure or the cavitation.

(6) The cam ring 8 is formed in such a manner that the cam profile radius change rate decreases first, then increases, then decreases again after that, then increases again after that, and then decreases again after that on the second confining region side when the eccentric amount δ of the cam ring is maximized.

Therefore, the fifth embodiment can prevent or reduce the surge pressure during the low-revolution operation.

(7) The cam ring 8 is formed in such a manner that the cam profile radius change rate has a positive value as the minimum value in one of the two reductions of the cam profile radius change rate on the second confining region side when the eccentric amount δ of the cam ring is maximized.

Therefore, the fifth embodiment can prevent or reduce the surge pressure during the low-revolution operation.

[Sixth Embodiment]

Figure 14:
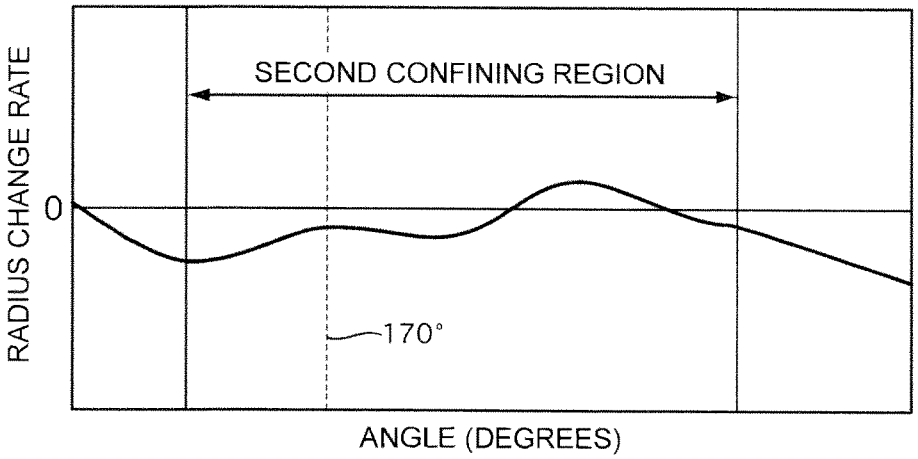
FIG. 14 illustrates the cam profile radius change rate with respect to the cam ring profile defining angle when the eccentric amount of the cam ring is minimized according to a sixth embodiment.

FIG. 14 illustrates the cam profile radius change rate with respect to the cam ring profile defining angle when the eccentric amount of the cam ring is minimized according to a sixth embodiment.

As illustrated in FIG. 14, the sixth embodiment is different from the second embodiment in terms of the cam ring 8 formed in such a manner that the cam profile radius change rate decreases first, then increases, then decreases again after that, then increases again after that, and then decreases again after that on the second confining region side when the eccentric amount of the cam ring is minimized.

Now, a function of the sixth embodiment will be described.

According to the sixth embodiment, the cam profile radius change rate shifts to an increase twice although it starts decreasing first. Therefore, the sixth embodiment can slow down the compression speed and the expansion speed, thereby preventing or reducing the cavitation during the high-revolution operation.

The variable displacement vane pump according to the sixth embodiment has the following effect in addition to the effect (2) of the second embodiment and the effect (5) of the fifth embodiment.

(8) The cam ring 8 is formed in such a manner that the cam profile radius change rate decreases first, then increases, then decreases again after that, then increases again after that, and then decreases again after that on the second confining region side when the eccentric amount δ of the cam ring 8 is minimized.

Therefore, the sixth embodiment can prevent or reduce the cavitation during the high-revolution operation.

[Seventh Embodiment]

Figure 15:
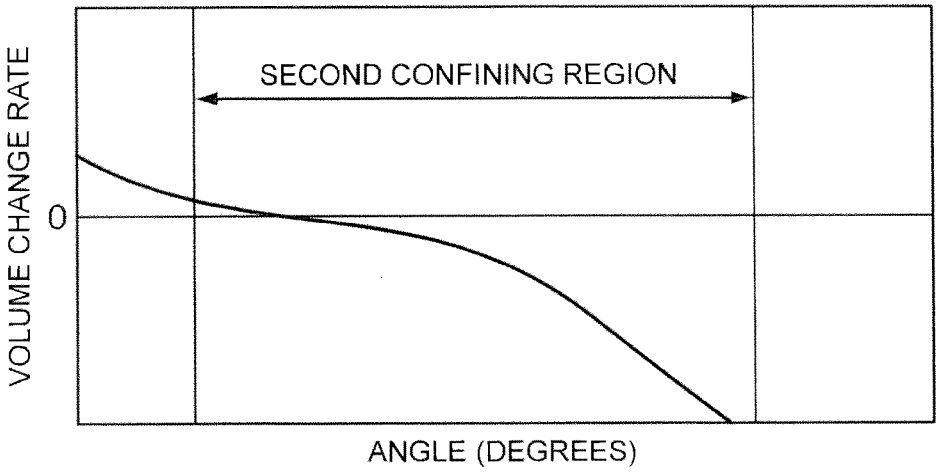
FIG. 15 illustrates the volume change rate with respect to the cam ring profile defining angle when the eccentric amount of the cam ring is maximized according to a seventh embodiment.

FIG. 15 illustrates the volume change rate with respect to the cam ring profile defining angle (the angle of the back-side vane 7) when the eccentric amount of the cam ring is maximized according to a seventh embodiment.

As illustrated in FIG. 15, the seventh embodiment is different from the second embodiment in terms of the cam ring 8 formed in such a manner that the volume change rate has a positive value at a position corresponding to the start end C of the discharge port 44 when the eccentric amount δ of the cam ring 8 is maximized, assuming that the volume change rate means the volume change rate of each pump chamber r in the rotational direction of the driving shaft 5.

Now, a function of the seventh embodiment will be described.

According to the seventh embodiment, the volume change rate has a positive value at the point (the start end C) where the pump chamber starts communication with the discharge port 44 (the notch 521). Therefore, the seventh embodiment can slow down the compression speed, thereby preventing or reducing the surge pressure during the low-revolution operation.

The variable displacement vane pump according to the seventh embodiment has the following effect in addition to the effect (2) of the second embodiment.

(9) The cam ring 8 is formed in such a manner that the volume change rate has a positive value at the position corresponding to the start end C of the discharge port 44 when the eccentric amount δ of the cam ring 8 is maximized, assuming that the volume change rate means the volume change rate of each of the plurality of pump chambers r in the rotational direction of the driving shaft 5.

Therefore, the seventh embodiment can prevent or reduce the surge pressure during the low-revolution operation.

[Eighth Embodiment]

Figure 16:
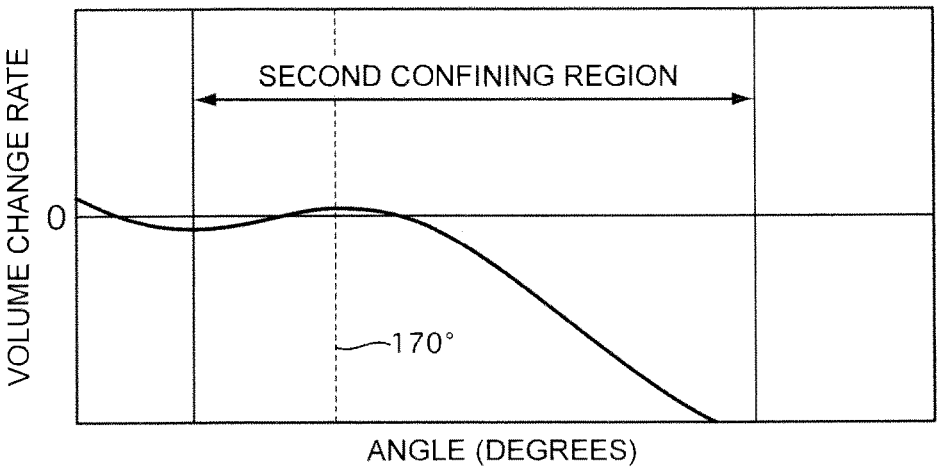
FIG. 16 illustrates the volume change rate with respect to the cam ring profile defining angle when the eccentric amount of the cam ring is maximized according to an eighth embodiment.

FIG. 16 illustrates the volume change rate with respect to the cam ring profile defining angle (the angle of the back-side vane 7) when the eccentric amount of the cam ring is maximized according to an eighth embodiment.

As illustrated in FIG. 16, the eighth embodiment is different from the second embodiment in terms of the cam ring 8 formed in such a manner that the volume change rate has a positive value at a point corresponding to the cam ring profile defining angle of 170 degrees when the eccentric amount δ of the cam ring 8 is maximized, assuming that the volume change rate means the volume change rate of each pump chamber r in the rotational direction of the driving shaft 5. Further, according to the eighth embodiment, the cam ring 8 is formed in such a manner that the volume change rate has a negative value at the position corresponding to the start end C of the discharge port 44 when the eccentric amount δ of the cam ring 8 is maximized.

Now, a function of the eighth embodiment will be described.

According to the eighth embodiment, the volume change rate has a positive value even at the point corresponding to the cam ring profile defining angle of 170 degrees. Therefore, the eighth embodiment can slow down the compression speed, thereby preventing or reducing the surge pressure during the low-revolution operation.

Further, the volume change rate has a negative value at the point where the pump chamber r starts communication with the discharge port 44 (the notch 521). Therefore, the eighth embodiment can provide a so-called pre-compression, thereby reducing a pressure change when the pump chamber r starts communication with the discharge port 44. As a result, the eighth embodiment can prevent or reduce generation of an abnormal noise.

The variable displacement vane pump according to the eighth embodiment has the following effects in addition to the effect (2) of the second embodiment.

(10) The cam ring 8 is formed in such a manner that the volume change rate has a positive value at the point corresponding to the cam ring profile defining angle of 170 degrees when the eccentric amount 5 of the cam ring 8 is maximized, assuming that the volume change rate means the volume change rate of each of the plurality of pump chambers r in the rotational direction of the driving shaft 5.

Therefore, the eighth embodiment can prevent or reduce the surge pressure during the low-revolution operation.

(11) The cam ring 8 is formed in such a manner that the volume change rate has a negative value at the position corresponding to the start end C of the discharge port 44 when the eccentric amount δ of the cam ring 8 is maximized, assuming that the volume change rate means the volume change rate of each of the plurality of pump chambers r in the rotational direction of the driving shaft 5.

Therefore, the eighth embodiment can reduce the pressure change when the pump chamber starts communication with the discharge port 44, thereby preventing or reducing the generation of the abnormal noise.

[Ninth Embodiment]

Figure 17:
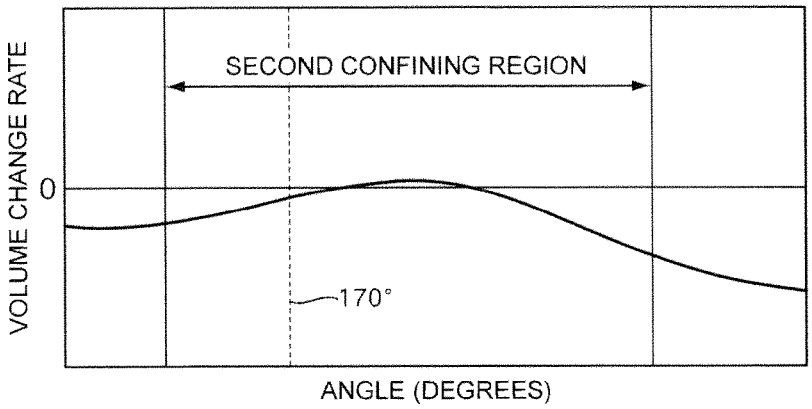
FIG. 17 illustrates the volume change rate with respect to the cam ring profile defining angle when the eccentric amount of the cam ring is minimized according to a ninth embodiment.

FIG. 17 illustrates the volume change rate with respect to the cam ring profile defining angle (the angle of the backside vane 7) when the eccentric amount of the cam ring is minimized according to a ninth embodiment.

As illustrated in FIG. 17, the ninth embodiment is different from the second embodiment in terms of the cam ring 8 formed in such a manner that the volume change rate has a negative value at the point corresponding to the cam ring profile defining angle of 170 degrees when the eccentric amount δ of the cam ring 8 is minimized, assuming that the volume change rate means the volume change rate of each of the plurality of pump chambers r in the rotational direction of the driving shaft 5.

Now, a function of the ninth embodiment will be described now.

According to the ninth embodiment, the volume change rate has a negative value even at the point corresponding to the cam ring profile defining angle of 170 degrees. Therefore, the eighth embodiment can slow down the expansion speed, thereby preventing or reducing the cavitation during the high-revolution operation.

The variable displacement vane pump according to the ninth embodiment has the following effect in addition to the effect (2) of the second embodiment.

(12) The cam ring 8 is formed in such a manner that the volume change rate has a negative value at the point corresponding to the cam ring profile defining angle of 170 degrees when the eccentric amount δ of the cam ring 8 is minimized, assuming that the volume change rate means the volume change rate of each of the plurality of pump chambers r in the rotational direction of the driving shaft 5.

Therefore, the ninth embodiment can prevent or reduce the cavitation during the high-revolution operation.

[Tenth Embodiment]

A variable displacement vane pump according to a tenth embodiment is different from the first embodiment in terms of the cam ring 8 formed in such a manner that the volume change rate decreases first and then increases again on the second confining region side when the eccentric amount δ of the cam ring 8 is maximized, assuming that the volume change rate means the volume change rate of each of the plurality of pump chambers r in the rotational direction of the driving shaft 5.

The volume change rate with respect to the cam ring profile defining angle when the eccentric amount of the cam ring is maximized according to the tenth embodiment is similar to FIG. 16.

More specifically, according to the tenth embodiment, the cam ring 8 is formed in such a manner that the volume change rate decreases first and then increases again on the second confining region side when the eccentric amount δ of the cam ring 8 is maximized, and the volume change rate has a negative value at the position corresponding to the start end C of the discharge port 44 when the eccentric amount δ of the cam ring 8 is maximized, assuming that the volume change rate means the volume change rate of each of the plurality of pump chambers r in the rotational direction of the driving shaft 5.

The normal inclination of the cam support surface 93 is similar to the first embodiment.

Now, a function of the tenth embodiment will be described.

According to the tenth embodiment, the volume change rate shifts to an increase again although it starts decreasing first. Therefore, the tenth embodiment can slow down the compression speed, thereby preventing or reducing the surge pressure during the low-revolution operation.

Further, the volume change rate has a negative value at the point where the pump chamber starts communication with the discharge port 44 (the notch 521). Therefore, the tenth embodiment can provide the so-called pre-compression, thereby reducing the pressure change when the pump chamber r starts communication with the discharge port 44. As a result, the tenth embodiment can prevent or reduce the generation of the abnormal noise.

The function of preventing or reducing the surge pressure and the cavitation due to the normal inclination of the cam support surface 93 is similar to the first embodiment.

The variable displacement vane pump according to the tenth embodiment has the following effects.

(13) The variable displacement vane pump according to the tenth embodiment includes the body 4 (the rear body 40, the plate 41, and the front body 42) including the pump element containing portion, the driving shaft 5 rotatably supported by the body 4, the rotor 6 disposed in the body 4, configured to be rotatably driven by the driving shaft 5, and including the plurality of slits 61 in the circumferential direction, the plurality of vanes 7 disposed so as to be able to be projected from and inserted into the slits 61, the cam support surface 93 formed on the inner circumferential side of the pump element containing portion, the cam ring 8 disposed movably as if it rolls on the cam support surface 93 in the pump element containing portion, annularly formed, and defining the plurality of pump chambers r on the inner circumferential side thereof together with the rotor 6 and the vanes 7, the intake port 43 formed at the body 4 so as to be opened in the intake region of the plurality of pump chambers r, which region is a region where volume thereof increases as the rotor 6 rotates, and disposed opposite of the driving shaft 5 from the cam support surface 93, the discharge port 44 formed at the body 4 so as to be opened in the discharge region of the plurality of pump chambers r, which region is a region where volume thereof decreases as the rotor 6 rotates, and disposed closer to the cam support surface 93 with respect to the driving shaft 5, and the control portion 3 disposed at the body 4 and configured to control the eccentric amount δ of the cam ring 8 with respect to the rotor 6. Assume that the respective terms mean the following definitions. The start end A of the intake port 43 is the point where one of the vanes 7 is placed into alignment with the intake port 43 for the first time after moving away from the discharge region as the rotor 6 rotates. The terminal end B of the intake port 43 is the point where one of the vanes 7 is in alignment with the intake port 43 for the last time in the intake region as the rotor 6 rotates. The start end C of the discharge port 44 is the point where one of the vanes 7 is placed into alignment with the discharge port 44 for the first time after moving away from the intake region as the rotor 6 rotates. The terminal end D of the discharge port 44 is the point where one of the vanes 7 is in alignment with the discharge port 44 for the last time in the discharge region as the rotor 6 rotates. The first confining region is the region between the terminal end D of the discharge port 44 and the start end A of the intake port 43. The second confining region is the space between the terminal end B of the intake port 43 and the start end C of the discharge port 44. The circumferential direction is the rotational direction of the driving shaft 5. The reference point is the middle point between the start end A of the intake port 43 and the terminal end D of the discharge port 44 in the circumferential direction. The reference line is the line perpendicularly intersecting with the rotational axis of the driving shaft 5 and passing through the reference point. The volume change rate is the volume change rate of each of the plurality of pump chambers r in the rotational direction of the driving shaft 5. The cam profile radius is the distance between the center P of the inner circumferential surface of the cam ring 8 and the inner circumferential surface of the cam ring 8. The cam ring profile defining angle is defined in such a manner that, when the cam ring 8 is placed in such a manner that the center P of the inner circumferential surface of the cam ring 8 coincides with the rotational axis O of the driving shaft 5, the angle of 0 degree as the cam ring profile defining angle is set to the one of the pair of points intersecting with the reference line that is located on the first confining region side among the points on the inner circumferential surface of the cam ring 8, and the respective points on the inner circumferential surface of the cam ring 8 have angles increasing along the inner circumferential surface of the cam ring 8 in the rotational direction of the driving shaft 5 so that the angle defined by one rotation throughout the inner circumferential surface of the cam ring 8 becomes 360 degrees. In this case, the cam support surface 93 is formed in such a manner that the shortest distance L between the cam support surface 93 and the reference line decreases from the second confining region side toward the first confining region side, and the cam ring 8 is formed in such a manner that the volume change rate decreases first and then increases again on the second confining region side when the eccentric amount δ of the cam ring 8 is maximized.

Therefore, because the cam support surface 93 has the so-called normal inclination, the tenth embodiment can reduce the compression rate in the second confining region when the eccentric amount of the cam ring is maximized, thereby preventing or reducing the surge pressure during the low-revolution operation, and can increase the compression rate in the second confining region when the eccentric amount of the cam ring is minimized, thereby preventing or reducing the occurrence of the cavitation during the high-revolution operation. Further, since the volume change rate shifts to an increase again although it starts decreasing first, the tenth embodiment can slow down the compression speed when the eccentric amount is maximized, thereby preventing or reducing the surge pressure during the low-revolution operation.

(14) The cam ring 8 is formed in such a manner that the volume change rate has a negative value at the position corresponding to the start end C of the discharge port 44 when the eccentric amount δ of the cam ring 8 is maximized.

Therefore, the tenth embodiment can reduce the pressure change when the pump chamber starts communication with the discharge port 44, thereby preventing or reducing the generation of the abnormal noise.

[Eleventh Embodiment]

A variable displacement vane pump according to an eleventh embodiment is different from the tenth embodiment in terms of the cam ring 8 formed in such a manner that the volume change rate decreases first and then increases again, and has a negative value as a maximum value when increasing again in this manner on the second confining region side when the eccentric amount δ of the cam ring 8 is minimized. The volume change rate with respect to the cam ring profile defining angle when the eccentric amount of the cam ring is minimized according to the eleventh embodiment is similar to FIG. 12.

Now, a function of the eleventh embodiment will be described.

According to the eleventh embodiment, the volume change rate has a negative value when increasing again with the eccentric amount of the cam ring minimized. Therefore, the eleventh embodiment can reduce the expansion when the eccentric amount δ is small, resulting in preventing or reducing the cavitation during the high-revolution operation.

The variable displacement vane pump according to the eleventh embodiment has the following effect in addition to the effect (13) of the tenth embodiment.

(15) The cam ring 8 is formed in such a manner that the volume change rate decreases first and then increases again, and has a negative value as the maximum value when increasing again in this manner on the second confining region side when the eccentric amount δ of the cam ring 8 is minimized.

Therefore, the eleventh embodiment can prevent or reduce the cavitation during the high-revolution rotation.

[Twelfth Embodiment]

A variable displacement vane pump according to a twelfth embodiment is different from the tenth embodiment in terms of the cam ring 8 formed in such a manner that the volume change rate decreases first and then increases again, and has a negative value as a maximum value when increasing again in this manner on the second confining region side when the eccentric amount δ of the cam ring 8 is maximized. The volume change rate with respect to the cam ring profile defining angle when the eccentric amount of the cam ring is maximized according to the twelfth embodiment is similar to FIG. 12.

Now, a function of the twelfth embodiment will be described.

An increase in the maximum value when the volume change rate increases again leads to an increase in the expansion rate when the eccentric amount δ is large. Therefore, because the volume change rate has a negative value as this maximum value, the twelfth embodiment can reduce the expansion when the eccentric amount is large, resulting in preventing or reducing the cavitation during the low-revolution operation.

The variable displacement vane pump according to the twelfth embodiment has the following effect in addition to the effect (13) of the tenth embodiment.

(16) The cam ring 8 is formed in such a manner that the volume change rate decreases first and then increases again, and has a negative value as the maximum value when increasing again in this manner on the second confining region side when the eccentric amount δ of the cam ring 8 is maximized.

Therefore, the twelfth embodiment can prevent or reduce the cavitation during the low-revolution operation.

[Thirteenth Embodiment]

A variable displacement vane pump according to a thirteenth embodiment is different from the tenth embodiment in terms of the cam ring 8 formed in such a manner that the volume change rate has a negative value at the point corresponding to the cam ring profile defining angle of 170 degrees when the eccentric amount δ of the cam ring 8 is minimized. The volume change rate with respect to the cam ring profile defining angle when the eccentric amount of the cam ring is minimized according to the thirteenth embodiment is similar to FIG. 17.

Now, a function of the thirteenth embodiment will be described.

According to the thirteenth embodiment, the volume change rate has a negative value even at the point corresponding to the cam ring profile defining angle of 170 degrees. Therefore, the thirteenth embodiment can slow down the expansion speed, thereby preventing or reducing the cavitation during the high-revolution operation.

The variable displacement vane pump according to the thirteenth embodiment has the following effect in addition to the effect (13) of the tenth embodiment.

(17) The cam ring 8 is formed in such a manner that the volume change rate has a negative value at the point corresponding to the cam ring profile defining angle of 170 degrees when the eccentric amount δ of the cam ring 8 is minimized.

Therefore, the thirteenth embodiment can prevent or reduce the cavitation during the high-revolution operation.

[Fourteenth Embodiment]

A variable displacement vane pump according to a fourteenth embodiment is different from the first embodiment in terms of the cam support surface 93 formed in parallel with the reference line. The cam ring profile of the cam ring 8 is similar to the first embodiment.

Now, a function of the fourteenth embodiment will be described.

According to the fourteenth embodiment, the cam ring 8 is formed in such a manner that the cam profile radius change rate decreases first and then increases again on the second confining region side when the eccentric amount δ of the cam ring 8 is maximized. Therefore, the cam profile radius change rate shifts to an increase again although it starts decreasing first. Accordingly, the fourteenth embodiment can slow down the compression speed, thereby preventing or reducing the surge pressure during the low-revolution operation, compared to the perfect circle cam.

The variable displacement vane pump according to the fourteenth embodiment has the following effect.

(18) The variable displacement vane pump according to the fourteenth embodiment includes the body 4 (the rear body 40, the plate 41, and the front body 42) including the pump element containing portion, the driving shaft 5 rotatably supported by the body 4, the rotor 6 disposed in the body 4, configured to be rotatably driven by the driving shaft 5, and including the plurality of slits 61 in the circumferential direction, the plurality of vanes 7 disposed so as to be able to be projected from and inserted into the slits 61, the cam support surface 93 formed on the inner circumferential side of the pump element containing portion, the cam ring 8 disposed movably as if it rolls on the cam support surface 93 in the pump element containing portion, annularly formed, and defining the plurality of pump chambers r on the inner circumferential side thereof together with the rotor 6 and the vanes 7, the intake port 43 formed at the body 4 so as to be opened in the intake region of the plurality of pump chambers r, which region is a region where volume thereof increases as the rotor 6 rotates, and disposed opposite of the driving shaft 5 from the cam support surface 93, the discharge port 44 formed at the body 4 so as to be opened in the discharge region of the plurality of pump chambers r, which region is a region where volume thereof decreases as the rotor 6 rotates, and disposed closer to the cam support surface 93 with respect to the driving shaft 5, and the control portion 3 disposed at the body 4 and configured to control the eccentric amount δ of the cam ring 8 with respect to the rotor 6. Assume that the respective terms mean the following definitions. The start end A of the intake port 43 is the point where one of the vanes 7 is placed into alignment with the intake port 43 for the first time after moving away from the discharge region as the rotor 6 rotates. The terminal end B of the intake port 43 is the point where one of the vanes 7 is in alignment with the intake port 43 for the last time in the intake region as the rotor rotates. The start end C of the discharge port 44 is the point where one the vanes 7 is placed into alignment with the discharge port 44 for the first time after moving away from the intake region as the rotor rotates. The terminal end D of the discharge port 44 is the point where one of the vanes 7 is in alignment with the discharge port 44 for the last time in the discharge region as the rotor rotates. The first confining region is the region between the terminal end D of the discharge port 44 and the start end A of the intake port 43. The second confining region is the space between the terminal end B of the intake port 43 and the start end C of the discharge port 44. The circumferential direction is the rotational direction of the driving shaft 5. The reference point is the middle point between the start end A of the intake port 43 and the terminal end D of the discharge port 44 in the circumferential direction. The reference line is the line perpendicularly intersecting with the rotational axis of the driving shaft 5 and passing through the reference point. The cam profile radius is the distance between the center P of the inner circumferential surface of the cam ring 8 and the inner circumferential surface of the cam ring 8. The cam profile radius change rate is the change rate of the cam profile radius in the rotational direction of the driving shaft 5. The cam ring profile defining angle is defined in such a manner that, when the cam ring 8 is placed in such a manner that the center P of the inner circumferential surface of the cam ring 8 coincides with the rotational axis O of the driving shaft 5, the angle of 0 degree as the cam ring profile defining angle is set to the one of the pair of points intersecting with the reference line that is located on the first confining region side among the points on the inner circumferential surface of the cam ring 8, and the respective points on the inner circumferential surface of the cam ring 8 have angles increasing along the inner circumferential surface of the cam ring 8 in the rotational direction of the driving shaft 5 so that the angle defined by one rotation throughout the inner circumferential surface of the cam ring 8 becomes 360 degrees. In this case, the cam ring 8 is formed in such a manner that the cam profile radius change rate decreases first and then increases again on the second confining region side when the eccentric amount δ of the cam ring 8 is maximized.

Therefore, the cam profile radius change rate shifts to an increase again although it starts decreasing first. Accordingly, the fourteenth embodiment can slow down the compression speed when the eccentric amount of the cam ring is maximized, thereby preventing or reducing the surge pressure during the low-revolution operation.

[Fifteenth Embodiment]

A variable displacement vane pump according to a fifteenth embodiment is different from the fourteenth embodiment in terms of the cam ring 8 formed in such a manner that the cam profile radius change rate decreases first, then increases, then decreases again after that, then increases again after that, and then decreases again after that on the second confining region side when the eccentric amount of the cam ring is maximized. Further, according to the fifteenth embodiment, the cam ring 8 is formed in such a manner that the cam profile radius change rate has a positive value as a minimum value in one (the first one) of the two reductions of the cam profile radius change rate on the second confining region side when the eccentric amount of the cam ring is maximized. The cam profile radius change rate with respect to the cam ring profile defining angle when the eccentric amount of the cam ring is maximized according to the fifteenth embodiment is similar to FIG. 13.

Now, a function of the fifteenth embodiment will be described.

According to the fifteenth embodiment, the cam profile radius change rate shifts to an increase twice although it starts decreasing first. Therefore, the fifteenth embodiment can slow down the compression speed and the expansion speed, thereby preventing or reducing the surge pressure during the low-revolution operation.

Further, the cam profile radius change rate has a positive value as the minimum value in one of the two reductions thereof, whereby the fifteenth embodiment can slow down the compression speed, thereby preventing or reducing the surge pressure during the low-revolution operation.

The variable displacement vane pump according to the fifteenth embodiment has the following effects in addition to the effect (18) of the fourteenth embodiment.

(19) The cam ring 8 is formed in such a manner that the cam profile radius change rate decreases first, then increases, then decreases again after that, then increases again after that, and then decreases again after that on the second confining region side.

Therefore, the fifteenth embodiment can prevent or reduce the surge pressure or the cavitation.

(20) The cam ring 8 is formed in such a manner that the cam profile radius change rate has a positive value as the minimum value in one of the two reductions thereof on the second confining region side when the eccentric amount δ of the cam ring is maximized.

Therefore, the fifteenth embodiment can prevent or reduce the surge pressure during the low-revolution operation.

[Sixteenth Embodiment]

A variable displacement vane pump according to a sixteenth embodiment is different from the fourteenth embodiment in terms of the cam ring 8 formed in such a manner that the volume change rate has a positive value at the position corresponding to the start end C of the discharge port 44 when the eccentric amount δ of the cam ring 8 is maximized, assuming that the volume change rate means the volume change rate of each pump chamber r in the rotational direction of the driving shaft 5. The volume change rate with respect to the cam ring profile defining angle when the eccentric amount of the cam ring is maximized according to the sixteenth embodiment is similar to FIG. 15.

Now, a function of the sixteenth embodiment will be described.

According to the sixteenth embodiment, the volume change rate has a positive value at the point (the start end C) where the pump chamber starts communication with the discharge port 44 (the notch 521). Therefore, the sixteenth embodiment can slow down the compression speed, thereby preventing or reducing the surge pressure during the low-revolution operation.

The variable displacement vane pump according to the sixteenth embodiment has the following effect in addition to the effect (18) of the fourteenth embodiment.

(21) The cam ring 8 is formed in such a manner that the volume change rate has a positive value at the position corresponding to the start end C of the discharge port 44 when the eccentric amount δ of the cam ring 8 is maximized, assuming that the volume change rate means the volume change rate of each of the plurality of pump chamber r in the rotational direction of the driving shaft 5.

Therefore, the sixteenth embodiment can prevent or reduce the surge pressure during the low-revolution operation.

[Seventeenth Embodiment]

A variable displacement vane pump according to the seventeenth embodiment is different from the fourteenth embodiment in terms of the cam ring 8 formed in such a manner that the volume change rate has a positive value at the point corresponding to the cam ring profile defining angle of 170 degrees when the eccentric amount δ of the cam ring 8 is maximized, assuming that the volume change rate means the volume change rate of each pump chamber r in the rotational direction of the driving shaft 5. Further, according to the seventeenth embodiment, the cam ring 8 is formed in such a manner that the volume change rate has a negative value at the position corresponding to the start end C of the discharge port 44 when the eccentric amount δ of the cam ring 8 is maximized. The volume change rate with respect to the cam ring profile defining angle when the eccentric amount of the cam ring is maximized according to the seventeenth embodiment is similar to FIG. 16.

Now, a function of the seventeenth embodiment will be described.

According to the seventeenth embodiment, the volume change rate has a positive value even at the point corresponding to the cam ring profile defining angle of 170 degrees. Therefore, the seventeenth embodiment can slow down the compression speed, thereby preventing or reducing the surge pressure during the low-revolution operation.

Further, the volume change rate has a negative value at the point where the pump chamber r starts communication with the discharge port 44 (the notch 521). Therefore, the seventeenth embodiment can provide the so-called pre-compression, thereby reducing the pressure change when the pump chamber r starts communication with the discharge port 44. As a result, the seventeenth embodiment can prevent or reduce the generation of the abnormal noise.

The variable displacement vane pump according to the seventeenth embodiment has the following effects in addition to the effect (18) of the fourteenth embodiment.

(22) The cam ring 8 is formed in such a manner that the volume change rate has a positive value at the point corresponding to the cam ring profile defining angle of 170 degrees when the eccentric amount δ of the cam ring 8 is maximized, assuming that the volume change rate means the volume change rate of each of the plurality of pump chambers r in the rotational direction of the driving shaft 5.

Therefore, the seventeenth embodiment can prevent or reduce the surge pressure during the low-revolution operation.

(23) The cam ring 8 is formed in such a manner that the volume change rate has a negative value at the position corresponding to the start end C of the discharge port 44 when the eccentric amount δ of the cam ring 8 is maximized, assuming that the volume change rate means the volume change rate of each of the plurality of pump chambers r in the rotational direction of the driving shaft 5.

Therefore, the seventeenth embodiment can reduce the pressure change when the pump chamber starts communication with the discharge port 44, thereby preventing or reducing the generation of the abnormal noise.

[Eighteenth Embodiment]

A variable displacement vane pump according to an eighteenth embodiment is different from the tenth embodiment in terms of the cam support surface 93 formed in parallel with the reference line. The cam ring profile of the cam ring 8 is similar to the tenth embodiment.

Now, a function of the eighteenth embodiment will be described.

According to the eighteenth embodiment, the volume change rate shifts to an increase again although it starts decreasing first. Therefore, the eighteenth embodiment can slow down the compression speed, thereby preventing or reducing the surge pressure during the low-revolution operation.

The variable displacement vane pump according to the eighteenth embodiment has the following effect.

(24) The variable displacement vane pump according to the eighteenth embodiment includes the body 4 (the rear body 40, the plate 41, and the front body 42) including the pump element containing portion, the driving shaft 5 rotatably supported by the body 4, the rotor 6 disposed in the body 4, configured to be rotatably driven by the driving shaft 5, and including the plurality of slits 61 in the circumferential direction, the plurality of vanes 7 disposed so as to be able to be projected from and inserted into the slits 61, the cam support surface 93 formed on the inner circumferential side of the pump element containing portion, the cam ring 8 disposed movably as if it rolls on the cam support surface 93 in the pump element containing portion, annularly formed, and defining the plurality of pump chambers r on the inner circumferential side thereof together with the rotor 6 and the vanes 7, the intake port 43 formed at the body 4 so as to be opened in the intake region of the plurality of pump chambers r, which region is a region where volume thereof increases as the rotor 6 rotates, and disposed opposite of the driving shaft 5 from the cam support surface 93, the discharge port 44 formed at the body 4 so as to be opened in the discharge region of the plurality of pump chambers r, which region is a region where volume thereof decreases as the rotor 6 rotates, and disposed closer to the cam support surface 93 with respect to the driving shaft 5, and the control portion 3 disposed at the body 4 and configured to control the eccentric amount δ of the cam ring 8 with respect to the rotor 6. Assume that the respective terms mean the following definitions. The start end A of the intake port 43 is the point where one of the vanes 7 is placed into alignment with the intake port 43 for the first time after moving away from the discharge region as the rotor 6 rotates. The terminal end B of the intake port 43 is the point where one of the vanes 7 is in alignment with the intake port 43 for the last time in the intake region as the rotor 6 rotates. The start end C of the discharge port 44 is the point where one of the vanes 7 is placed into alignment with the discharge port 44 for the first time after moving away from the intake region the rotor 6 rotates. The terminal end D of the discharge port 44 is the point where one of the vanes 7 is in alignment with the discharge port 44 for the last time in the discharge region as the rotor 6 rotates. The first confining region is the region between the terminal end D of the discharge port 44 and the start end A of the intake port 43. The second confining region is the space between the terminal end B of the intake port 43 and the start end C of the discharge port 44. The circumferential direction is the rotational direction of the driving shaft 5. The reference point is the middle point between the start end A of the intake port 43 and the terminal end D of the discharge port 44 in the circumferential direction. The reference line is the line perpendicularly intersecting with the rotational axis of the driving shaft 5 and passing through the reference point. The volume change rate is the volume change rate of each of the plurality of pump chambers r in the rotational direction of the driving shaft 5. The cam profile radius is the distance between the center P of the inner circumferential surface of the cam ring 8 and the inner circumferential surface of the cam ring 8. The cam ring profile defining angle is defined in such a manner that, when the cam ring 8 is placed in such a manner that the center P of the inner circumferential surface of the cam ring 8 coincides with the rotational axis O of the driving shaft 5, the angle of 0 degree as the cam ring profile defining angle is set to the one of the pair of points intersecting with the reference line that is located on the first confining region side among the points on the inner circumferential surface of the cam ring 8, and the respective points on the inner circumferential surface of the cam ring 8 have angles increasing along the inner circumferential surface of the cam ring 8 in the rotational direction of the driving shaft 5 so that the angle defined by one rotation throughout the inner circumferential surface of the cam ring 8 becomes 360 degrees. In this case, the cam ring 8 is formed in such a manner that the volume change rate decreases first and then increases again on the second confining region side when the eccentric amount δ of the cam ring 8 is maximized.

Therefore, the volume change rate shifts to an increase again although it starts decreasing first. Accordingly, the eighteenth embodiment can slow down the compression speed when the eccentric amount of the cam ring is maximized, thereby preventing or reducing the surge pressure during the low-revolution operation.

[Nineteenth Embodiment]

A variable displacement vane pump according to a nineteenth embodiment is different from the eighteenth embodiment in terms of the cam ring 8 formed in such a manner that the volume change rate has a negative value at the position corresponding to the start end C of the discharge port 44 when the eccentric amount δ of the cam ring 8 is maximized. The volume change rate with respect to the cam ring profile defining angle when the eccentric amount of the cam ring is maximized according to the nineteenth embodiment is similar to FIG. 16.

Now, a function of the nineteenth embodiment will be described.

According to the nineteenth embodiment, the volume change rate has a negative value at the point where the pump chamber r starts communication with the discharge port 44 (the notch 521). Therefore, the nineteenth embodiment can provide the so-called pre-compression, thereby reducing the pressure change when the pump chamber r starts communication with the discharge port 44. As a result, the nineteenth embodiment can prevent or reduce the generation of the abnormal noise.

The variable displacement vane pump according to the nineteenth embodiment has the following effect in addition to the effect (24) of the eighteenth embodiment.

(25) The cam ring 8 is formed in such a manner that the volume change rate has a negative value at the position corresponding to the start end C of the discharge port 44 when the eccentric amount δ of the cam ring 8 is maximized, assuming that the volume change rate means the volume change rate of each of the plurality of pump chambers r in the rotational direction of the driving shaft 5.

Therefore, the nineteenth embodiment can reduce the pressure change when the pump chamber starts communication with the discharge port 44, thereby preventing or reducing the generation of the abnormal noise.

For example, embodiments of the present invention may also be constructed as follows.

(1) A variable displacement vane pump comprising:

a pump housing including a pump element containing portion;

a driving shaft rotatably supported by the pump housing;

a rotor disposed in the pump housing and configured to be rotatably driven by the driving shaft, the rotor including a plurality of slits in a circumferential direction;

a plurality of vanes disposed so as to be configured to be projected from and inserted into the slits;

a cam support surface formed on an inner circumferential side of the pump element containing portion;

a cam ring disposed movably as if it rolls on the cam support surface in the pump element containing portion, the cam ring being annularly formed and defining a plurality of pump chambers on an inner circumferential side thereof together with the rotor and the vanes;

an intake port formed at the pump housing so as to be opened in an intake region of the plurality of pump chambers, the intake region being a region where volume thereof increases as the rotor rotates, the intake port being disposed opposite of the driving shaft from the cam support surface;

a discharge port formed at the pump housing so as to be opened in a discharge region of the plurality of pump chambers, the discharge region being a region where volume thereof decreases as the rotor rotates, the discharge port being disposed closer to the cam support surface with respect to the driving shaft; and a cam ring control mechanism (a control valve, first and second fluid pressure chambers, and the like) disposed at the pump housing and configured to control an eccentric amount of the cam ring with respect to the rotor, wherein the cam support surface is formed in such a manner that a shortest distance between the cam support surface and a reference line decreases from a second confining region side toward a first confining region side, and the cam ring is formed in such a manner that a cam profile radius change rate decreases first and then increases again on the second confining region side when eccentric amount of the cam ring is maximized, assuming that a start end of the intake port is a point where one of the plurality of vanes is placed into alignment with the intake port for the first time after moving away from the discharge region as the rotor rotates, a terminal end of the intake port is a point where one of the plurality of vanes is in alignment with the intake port for the last time in the intake region as the rotor rotates, a start end of the discharge port is a point where the vanes are placed into alignment with the discharge port for the first time after moving away from the intake region as the rotor rotates, a terminal end of the discharge port is a point where the vanes are in alignment with the discharge port for the last time in the discharge region as the rotor rotates, the first confining region is a region between the terminal end of the discharge port and the start end of the intake port, the second confining region is a space between the terminal end of the intake port and the start end of the discharge port, when the circumferential direction is a rotational direction of the driving shaft, a reference point is a middle point between the start end of the intake port and the terminal end of the discharge port in the circumferential direction, the reference line is a line perpendicularly intersecting with a rotational axis of a driving shaft and passing through the reference point, a cam profile radius is a distance between a center of an inner circumferential surface of the cam ring and the inner circumferential surface of the cam ring, the cam profile radius change rate is a change rate of the cam profile radius in the rotational direction of the driving shaft, and a cam ring profile defining angle is defined in such a manner that, when the cam ring is placed in such a manner that the center of the inner circumferential surface of the cam ring coincides with the rotational axis of the driving shaft, an angle of 0 degree as the cam ring profile defining angle is set to one of a pair of points intersecting with the reference line that is located on the first confining region side among points on the inner circumferential surface of the cam ring, and the respective points on the inner circumferential surface of the cam ring have angles increasing along the inner circumferential surface of the cam ring in the rotational direction of the driving shaft so that an angle defined by one rotation throughout the inner circumferential surface of the cam ring becomes 360 degrees.

According to the embodiment (1), since the cam support surface has a so-called normal inclination, it is possible to reduce a compression rate in the second confining region when the eccentric amount of the cam ring is maximized, thereby preventing or reducing a surge pressure during a low-revolution operation. Further, for a perfect circle cam having a perfect circle shape as a cam ring inner circumferential surface, in the second confining region, once the cam profile radius change rate starts decreasing, the cam profile radius change rate monotonously decreases with the hydraulic oil being compressed at an excessively high speed. On the other hand, according to the embodiment (1), because the cam profile radius change rate shifts to an increase again although it starts decreasing first, whereby it is possible to slow down a compression speed, thereby preventing or reducing the surge pressure during the low-revolution operation.

(2) The variable displacement vane pump according to the embodiment (1), wherein the cam ring is formed in such a manner that the cam profile radius change rate has a negative value at a point corresponding to the cam profile defining angle of 180 degrees when the eccentric amount of the cam ring is minimized.

According to the embodiment of (1), because the cam profile change rate has a negative value, i.e., the hydraulic oil is subjected to a compression process, it is possible to prevent or reduce cavitation during a high-revolution operation.

(3) The variable displacement vane pump according to the embodiment (2), wherein the cam ring is formed in such a manner that the cam profile radius change rate has a negative value as a maximum value when the cam profile radius change rate increases again after decreasing first on the second confining region side when the eccentric amount of the cam ring is minimized.

According to the embodiment (3), because an increase in the maximum value when the cam profile radius change rate increases again leads to an increase in an expansion rate when the eccentric amount is small, it is possible to reduce expansion when the eccentric amount is small due to this maximum value being a negative value, resulting in preventing or reducing the cavitation (4) The variable displacement vane pump according to the embodiment (2), wherein, assuming that a volume change rate means a volume change rate of each of the plurality of pump chambers in the rotational direction of the driving shaft, the cam ring is formed in such a manner that the volume change rate decreases first and then increases again, and has a negative value as a maximum value when increasing again in this manner on the second confining region side when the eccentric amount of the cam ring is minimized.

According to the embodiment (4), the volume change rate has a negative value when increasing again in a similar manner to the radius change rate. Therefore, it is possible to prevent or reduce expansion when the eccentric amount is small, resulting in preventing or reducing the cavitation.

(5) The variable displacement vane pump according to the embodiment (2), wherein the cam ring is formed in such a manner that the cam profile radius change rate decreases first, then increases, then decreases again after that, then increases again after that, and then decreases again after that on the second confining region side.

According to the embodiment (5), the cam profile radius change rate shifts to an increase twice although it starts decreasing first. Therefore, it is possible to slow down a compression speed and an expansion speed, thereby preventing or reducing a surge pressure or the cavitation.

(6) The variable displacement vane pump according to the embodiment (5), wherein the cam ring is formed in such a manner that the cam profile radius change rate decreases first, then increases, then decreases again after that, then increases again after that, and then decreases again after that on the second confining region side when the eccentric amount of the cam ring is maximized.

According to the embodiment (6), the cam profile radius change rate shifts to an increase twice although it starts decreasing first. Therefore, it is possible to slow down the compression speed, thereby preventing or reducing the surge pressure during a low-revolution operation.

(7) The variable displacement vane pump according to the embodiment (5), wherein the cam ring is formed in such a manner that the cam profile radius change rate decreases first, then increases, then decreases again after that, then increases again after that, and then decreases again after that on the second confining region side when the eccentric amount of the cam ring is minimized.

According to the embodiment (7), the cam profile radius change rate shifts to a decrease twice although it starts decreasing first and then increasing. Therefore, it is possible to slow down the expansion speed, thereby preventing or reducing the cavitation during the high-revolution operation.

(8) The variable displacement vane pump according to the embodiment (6), wherein the cam ring is formed in such a manner that the cam profile radius change rate has a positive value as a minimum value in one of the two reductions of the cam profile radius change rate on the second confining region side when the eccentric amount of the cam ring is maximized.

According to the embodiment (8), the cam profile radius change rate has a positive value as the minimum value in one of the two reductions thereof. Therefore, it is possible to slow down the compression speed, thereby preventing or reducing the surge pressure during the low-revolution operation.

(9) The variable displacement vane pump according to the embodiment (2), wherein, assuming that a volume change rate means a volume change rate of each of the plurality of pump chambers in the rotational direction of the driving shaft, the cam ring is formed in such a manner that the volume change rate has a positive value at a position corresponding to the start end of the discharge port when the eccentric amount of the cam ring is maximized.

According to the embodiment (9), the volume change rate has a positive value at a point where the pump chamber starts communication with the discharge port (a notch). Therefore, it is possible to slow down a compression speed, thereby preventing or reducing the surge pressure during the low-revolution operation.

(10) The variable displacement vane pump according to the embodiment (2), wherein, assuming that a volume change rate means a volume change rate of each of the plurality of pump chambers in the rotational direction of the driving shaft, the cam ring is formed in such a manner that the volume change rate has a positive value at a point corresponding to the cam ring profile defining angle of 170 degrees when the eccentric amount of the cam ring is maximized.

According to the embodiment (10), the volume change rate has a positive value even at the point corresponding to the cam ring profile defining angle of 170 degrees. Therefore, it is possible to slow down a compression speed, thereby preventing or reducing the surge pressure during the low-revolution operation.

(11) The variable displacement vane pump according to the embodiment (1), wherein, assuming that a volume change rate means a volume change rate of each of the plurality of pump chambers in the rotational direction of the driving shaft, the cam ring is formed in such a manner that the volume change rate has a negative value at a point corresponding to the cam ring profile defining angle of 170 degrees when the eccentric amount of the cam ring is minimized.

According to the embodiment (11), the volume change rate has a negative value at the point corresponding to the cam ring profile defining angle of 170 degrees. Therefore, it is possible to slow down an expansion speed, thereby preventing or reducing cavitation during a high-revolution operation.

(12) The variable displacement vane pump according to the embodiment (1), wherein, assuming that a volume change rate means a volume change rate of each of the plurality of pump chambers in the rotational direction of the driving shaft, the cam ring is formed in such a manner that the volume change rate has a negative value at a position corresponding to the start end of the discharge port when the eccentric amount of the cam ring is maximized.

According to the embodiment (12), the volume change rate has a negative value at a point where the pump chamber starts communication with the discharge port (a notch). Therefore, it is possible to provide a so-called pre-compression, thereby reducing a pressure change when the pump chamber starts communication with the discharge port, resulting in a success in preventing or reducing generation of an abnormal noise.

(13) A variable displacement vane pump comprising:

a pump housing including a pump element containing portion;

a driving shaft rotatably supported by the pump housing;

a rotor disposed in the pump housing and configured to be rotatably driven by the driving shaft, the rotor including a plurality of slits in a circumferential direction;

a plurality of vanes disposed so as to be configured to be projected from and inserted into the slits;

a cam support surface formed on an inner circumferential side of the pump element containing portion;

a cam ring disposed movably as if it rolls on the cam support surface in the pump element containing portion, the cam ring being annularly formed and defining a plurality of pump chambers on an inner circumferential side thereof together with the rotor and the vanes;

an intake port formed at the pump housing so as to be opened in an intake region of the plurality of pump chambers, the intake region being a region where volume thereof increases as the rotor rotates, the intake port being disposed opposite of the driving shaft from the cam support surface;

a discharge port formed at the pump housing so as to be opened in a discharge region of the plurality of pump chambers, the discharge region being a region where volume thereof decreases as the rotor rotates, the discharge port being disposed closer to the cam support surface with respect to the driving shaft; and a cam ring control mechanism (a control valve, first and second fluid pressure chambers, and the like) disposed at the pump housing and configured to control an eccentric amount of the cam ring with respect to the rotor, wherein the cam support surface is formed in such a manner that a shortest distance between the cam support surface and a reference line decreases from a second confining region side toward a first confining region side, and the cam ring is formed in such a manner that a volume change rate decreases first and then increases again on the second confining region side when eccentric amount of the cam ring is maximized, assuming that a start end of the intake port is a point where one of the plurality of vanes is placed into alignment with the intake port for the first time after moving away from the discharge region as the rotor rotates, a terminal end of the intake port is a point where one of the plurality of vanes is in alignment with the intake port for the last time in the intake region as the rotor rotates, a start end of the discharge port is a point where the vanes are placed into alignment with the discharge port for the first time after moving away from the intake region as the rotor rotates, a terminal end of the discharge port is a point where the vanes are in alignment with the discharge port for the last time in the discharge region as the rotor rotates, the first confining region is a region between the terminal end of the discharge port and the start end of the intake port, the second confining region is a space between the terminal end of the intake port and the start end of the discharge port, when the circumferential direction is a rotational direction of the driving shaft, a reference point is a middle point between the start end of the intake port and the terminal end of the discharge port in the circumferential direction, the reference line is a line perpendicularly intersecting with a rotational axis of a driving shaft and passing through the reference point, the volume change rate is a volume change rate of each of the plurality of pump chambers in the rotational direction of the driving shaft, and a cam ring profile defining angle is defined in such a manner that, when the cam ring is placed in such a manner that a center of an inner circumferential surface of the cam ring coincides with the rotational axis of the driving shaft, an angle of 0 degree as the cam ring profile defining angle is set to one of a pair of points intersecting with the reference line that is located on the first confining region side among points on the inner circumferential surface of the cam ring, and the respective points on the inner circumferential surface of the cam ring have angles increasing along the inner circumferential surface of the cam ring in the rotational direction of the driving shaft so that an angle defined by one rotation throughout the inner circumferential surface of the cam ring becomes 360 degrees.

According to the embodiment (13), since the cam support surface has a so-called normal inclination, it is possible to reduce a compression rate in the second confining region when the eccentric amount of the cam ring is maximized, thereby preventing or reducing a surge pressure during a low-revolution operation. Further, since the volume change rate shifts to an increase again although it starts decreasing first, the embodiment (13) can slow down a compression speed, thereby preventing or reducing the surge pressure during the low-revolution operation.

(14) The variable displacement vane pump according to the embodiment (13), wherein the cam ring is formed in such a manner that the volume change rate has a negative value at a position corresponding to the start end of the discharge port when the eccentric amount of the cam ring is maximized.

According to the embodiment (14), the volume change rate has a negative value at a point where the pump chamber starts communication with the discharge port (a notch). Therefore, it is possible to provide a so-called pre-compression, thereby reducing a pressure change when the pump chamber starts communication with the discharge port, resulting in a success in preventing or reducing generation of an abnormal noise.

(15) The variable displacement vane pump according to the embodiment (13), wherein the cam ring is formed in such a manner that the volume change rate decreases first and then increases again, and has a negative value as a maximum value when increasing again in this manner on the second confining region side when the eccentric amount of the cam ring is minimized.

According to the embodiment (15), the volume change rate has a negative value when increasing again in a similar manner to a radius change rate. Therefore, it is possible to prevent or reduce expansion when the eccentric amount is small, resulting in preventing or reducing cavitation.

(16) The variable displacement vane pump according to the embodiment (13), wherein, assuming that a cam profile radius is a distance between the center of the inner circumferential surface of the cam ring and the inner circumferential surface of the cam ring, and a cam profile radius change rate is a change rate of the cam profile radius in the rotational direction of the driving shaft, the cam ring is formed in such a manner that the cam profile radius change rate has a negative value as a maximum value when the cam profile radius change rate increases again after decreasing first on the second confining region side when the eccentric amount of the cam ring is minimized.

According to the embodiment (16), because an increase in the maximum value when the cam profile radius change rate increases again leads to an increase in an expansion rate when the eccentric amount is small, it is possible to reduce expansion when the eccentric amount is small due to this maximum value being a negative value, resulting in preventing or reducing cavitation.

(17) The variable displacement vane pump according to the embodiment (13), wherein the cam ring is formed in such a manner that the volume change rate has a negative value at a point corresponding to the cam ring profile defining angle of 170 degrees when the eccentric amount of the cam ring is minimized.

According to the embodiment (17), the volume change rate has a negative value at the point corresponding to the cam ring profile defining angle of 170 degrees. Therefore, it is possible to slow down an expansion speed, thereby preventing or reducing cavitation during a high-revolution operation.

The present application claims priority under 35 U.S.C. section 119 to Japanese Patent Application No. 2013-194392 filed on Sep. 19, 2013.

The entire disclosure of Japanese Patent Application No. 2013-194392 filed on Sep. 19, 2013 including specification, claims, drawings and summary are incorporated herein by reference in its entirety.

What is claimed is:

1. A variable displacement vane pump comprising:

a pump housing;

a driving shaft rotatably supported by the pump housing;

a rotor disposed in the pump housing and configured to be rotatably driven by the driving shaft, the rotor including a plurality of slits in a circumferential direction;

a plurality of vanes disposed so as to be configured to be projected from and inserted into the slits;

a cam ring disposed swingably in the pump housing, the cam ring being annularly formed and defining a plurality of pump chambers on an inner circumferential side thereof together with the rotor and the vanes;

a limiting surface formed so as to surround the cam ring and configured to limit a swinging range of the cam ring, the limiting surface having a cam support surface providing a support surface for swinging movement of the cam ring;

an intake port formed at the pump housing so as to be opened in an intake region of the plurality of pump chambers, the intake region being a region where a volume thereof increases as the rotor rotates, the intake port being disposed opposite of the driving shaft from the cam support surface;

a discharge port formed at the pump housing so as to be opened in a discharge region of the plurality of pump chambers, the discharge region being a region where a volume thereof decreases as the rotor rotates, the discharge port being disposed closer to the cam support surface with respect to the driving shaft; and a control valve disposed at the pump housing and configured to control an eccentric amount of the cam ring with respect to the rotor, wherein the cam support surface is formed in such a manner that a shortest distance between the cam support surface and a reference line decreases from a second confining region side toward a first confining region side, an inner diameter of the cam ring varies along a circumferential direction, the cam ring has the inner diameter set in such a manner that when the eccentric amount of the cam ring is maximized, a change rate of a cam profile radius, which is a change rate of a distance between a center of an inner circumferential surface of the cam ring and the inner circumferential surface of the cam ring, decreases and then increases, viewed in a rotational direction of the driving shaft, in the second confining region, the first confining region is a region between a terminal end of the discharge port, which is an end point of the discharge port where one of the plurality of vanes in the discharge region reaches for a last time as the rotor rotates, and a start end of the intake port, which is an end point of the intake port where one of the plurality of vanes reaches for a first time after moving away from the discharge region as the rotor rotates, the second confining region is a region between a terminal end of the intake port, which is an end point of the intake port where one of the plurality of vanes in the intake region reaches for a last time as the rotor rotates, and a start end of the discharge port, which is an end point of the discharge port where one of the plurality of vanes reaches for a first time after moving away from the intake region as the rotor rotates, and the reference line is a line perpendicularly intersecting with the driving shaft and passing through a reference point which is a middle point between the start end of the intake port and the terminal end of the discharge port in a rotational direction of the driving shaft.

2. The variable displacement vane pump according to claim 1, wherein the cam ring has the inner diameter set in such a manner that when the eccentric amount of the cam ring is minimized, the change rate of the cam profile radius has a negative value at a point where the reference line and the inner circumference of the cam ring intersect each other.

3. The variable displacement vane pump according to claim 2, wherein the cam ring has the inner diameter set in such a manner that when the eccentric amount of the cam ring is minimized, the change rate of the cam profile radius has a negative value as a maximum value when the change rate of the cam profile radius increases after decreasing, in the second confining region.

4. The variable displacement vane pump according to claim 2, wherein the cam ring has the inner diameter set in such a manner that when the eccentric amount of the cam ring is minimized, a volume change rate, which is a change rate in which a volume of each of the plurality of pump chambers changes according to rotation of the driving shaft, decreases and then increases according to rotation of the driving shaft, and has a negative value as a maximum value of the volume change rate at the time of the increase of the volume change rate in the second confining region.

5. The variable displacement vane pump according to claim 2, wherein the cam ring has the inner diameter set in such a manner that the change rate of the cam profile radius decreases, then increases, then decreases again after that, then increases again after that, and then decreases again after that in the second confining region viewed in the rotational direction of the driving shaft.

6. The variable displacement vane pump according to claim 5, wherein the cam ring has the inner diameter set in such a manner that when the eccentric amount of the cam ring is maximized, the change rate of the cam profile radius decreases, then increases, then decreases again after that, then increases again after that, and then decreases again after that in the second confining region viewed in the rotational direction of the driving shaft.

7. The variable displacement vane pump according to claim 6, wherein the cam ring has the inner diameter set in such a manner that when the eccentric amount of the cam ring is maximized, the change rate of the cam profile radius decreases at least two times viewed in the rotational direction of the driving shaft, and has a positive value as a minimum value in one of the at least two decreases of the change rate of the cam profile radius in the second confining region.

8. The variable displacement vane pump according to claim 5, wherein the cam ring has the inner diameter set in such a manner that when the eccentric amount of the cam ring is minimized, the change rate of the cam profile radius decreases, then increases, then decreases again after that, then increases again after that, and then decreases again after that in the second confining region viewed in the rotational direction of the driving shaft.

9. The variable displacement vane pump according to claim 2, wherein the cam ring has the inner diameter set in such a manner that when the eccentric amount of the cam ring is maximized, a volume change rate, which is a change rate in which a volume of each of the plurality of pump chambers changes according to rotation of the driving shaft, has a positive value at a position corresponding to the start end of the discharge port.

10. The variable displacement vane pump according to claim 2, wherein the cam ring has the inner diameter set in such a manner that when the eccentric amount of the cam ring is maximized, a volume change rate, which is a change rate in which a volume of each of the plurality of pump chambers changes according to rotation of the driving shaft, has a positive value at a point which is rotated by 10 degrees around the center of the inner circumferential surface of the cam ring in a reverse direction of the rotational direction of the driving shaft from a point on the inner circumferential surface of the cam ring on the second confining region side that intersects with the reference line.

11. The variable displacement vane pump according to claim 1, wherein the cam ring has the inner diameter set in such a manner that when the eccentric amount of the cam ring is minimized, a volume change rate, which is a change rate in which a volume of each of the plurality of pump chambers changes according to rotation of the driving shaft, has a negative value at a point which is rotated by 10 degrees around the center of the inner circumferential surface of the cam ring in a reverse direction of the rotational direction of the driving shaft from a point on the inner circumferential surface of the cam ring on the second confining region side that intersects with the reference line.

12. The variable displacement vane pump according to claim 1, wherein the cam ring has the inner diameter set in such a manner that when the eccentric amount of the cam ring is maximized, a volume change rate, which is a change rate in which a volume of each of the plurality of pump chambers changes according to rotation of the driving shaft, has a negative value at a position corresponding to the start end of the discharge port.

13. A variable displacement vane pump comprising:

a pump housing;

a driving shaft rotatably supported by the pump housing;

a rotor disposed in the pump housing and configured to be rotatably driven by the driving shaft, the rotor including a plurality of slits in a circumferential direction;

a plurality of vanes disposed so as to be configured to be projected from and inserted into the slits;

a cam ring disposed swingably in the pump housing, the cam ring being annularly formed and defining a plurality of pump chambers on an inner circumferential side thereof together with the rotor and the vanes;

a limiting surface formed so as to surround the cam ring and configured to limit a swinging range of the cam ring, the limiting surface having a cam support surface providing a support surface for swinging movement of the cam ring;

an intake port formed at the pump housing so as to be opened in an intake region of the plurality of pump chambers, the intake region being a region where a volume thereof increases as the rotor rotates, the intake port being disposed opposite of the driving shaft from the cam support surface;

a discharge port formed at the pump housing so as to be opened in a discharge region of the plurality of pump chambers, the discharge region being a region where a volume thereof decreases as the rotor rotates, the discharge port being disposed closer to the cam support surface with respect to the driving shaft; and a control valve disposed at the pump housing and configured to control an eccentric amount of the cam ring with respect to the rotor, wherein the cam support surface is formed in such a manner that a shortest distance between the cam support surface and a reference line decreases from a second confining region side toward a first confining region side, an inner diameter of the cam ring varies along a circumferential direction, the cam ring has the inner diameter set in such a manner that a volume change rate, which is a change rate in which a volume of each of the plurality of pump chambers changes according to rotation of the driving shaft, decreases and then, in the second confining region, increases when the eccentric amount of the cam ring is maximized, the first confining region is a region between a terminal end of the discharge port, which is an end point of the discharge port where one of the plurality of vanes in the discharge region reaches for a last time as the rotor rotates, and a start end of the intake port, which is an end point of the intake port where one of the plurality of vanes reaches for a first time after moving away from the discharge region as the rotor rotates, the second confining region is a region between a terminal end of the intake port, which is an end point of the intake port where one of the plurality of vanes in the intake region reaches for a last time as the rotor rotates, and a start end of the discharge port, which is an end point of the discharge port where one of the plurality of vanes reaches for a first time after moving away from the intake region as the rotor rotates, and the reference line is a line perpendicularly intersecting with the driving shaft and passing through a reference point which is a middle point between the start end of the intake port and the terminal end of the discharge port in a rotational direction of the driving shaft.

14. The variable displacement vane pump according to claim 13, wherein the cam ring has the inner diameter set in such a manner that when the eccentric amount of the cam ring is maximized, a volume change rate, which is a change rate in which a volume of each of the plurality of pump chambers changes according to rotation of the driving shaft, has a negative value at a position corresponding to the start end of the discharge port.

15. The variable displacement vane pump according to claim 13, wherein the cam ring has the inner diameter set in such a manner that when the eccentric amount of the cam ring is minimized, a volume change rate, which is a change rate in which a volume of each of the plurality of pump chambers changes according to rotation of the driving shaft, decreases and then increases, and has a negative value as a maximum value at the time of the increase of the volume change rate in the second confining region.

16. The variable displacement vane pump according to claim 13, wherein the cam ring has the inner diameter set in such a manner that when the eccentric amount of the cam ring is minimized, a change rate of a cam profile radius, which is a change rate of a distance between a center of an inner circumferential surface of the cam ring and the inner circumferential surface of the cam ring, has a negative value as a maximum value when the cam profile radius change rate decreases and then increases, viewed in a rotational direction of the driving shaft, in the second confining region.

17. The variable displacement vane pump according to claim 13, wherein the cam ring has the inner diameter set in such a manner that when the eccentric amount of the cam ring is minimized, the volume change rate has a negative value at a point which is rotated by 10 degrees around the center of the inner circumferential surface of the cam ring in a reverse direction of the rotational direction of the driving shaft from a point on the inner circumferential surface of the cam ring on the second confining region side that intersects with the reference line.

* * * * *